US011533956B2

(12) United States Patent
Tanaka et al.

(10) Patent No.: US 11,533,956 B2
(45) Date of Patent: Dec. 27, 2022

(54) GARMENT AND ALERT SYSTEM

(71) Applicant: MAKITA CORPORATION, Anjo (JP)

(72) Inventors: Tsuyoshi Tanaka, Anjo (JP); Yuki Mizukoshi, Anjo (JP); Ryo Umemoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 256 days.

(21) Appl. No.: 16/629,653

(22) PCT Filed: May 22, 2018

(86) PCT No.: PCT/JP2018/019687
§ 371 (c)(1),
(2) Date: Jan. 9, 2020

(87) PCT Pub. No.: WO2019/012811
PCT Pub. Date: Jan. 17, 2019

(65) Prior Publication Data

US 2021/0076757 A1 Mar. 18, 2021

(30) Foreign Application Priority Data

Jul. 13, 2017 (JP) ..... JP2017-137349

(51) Int. Cl.

| | |
|---|---|
| ***G08B 5/22*** | (2006.01) |
| ***A41D 1/00*** | (2018.01) |
| ***G08B 7/06*** | (2006.01) |
| ***G08B 21/02*** | (2006.01) |
| *B25F 5/00* | (2006.01) |

(52) U.S. Cl.
CPC ..... *A41D 1/002* (2013.01); *G08B 7/06* (2013.01); *G08B 21/02* (2013.01); *B25F 5/00* (2013.01)

(58) Field of Classification Search
CPC ..... A41D 1/002; G08B 7/06; G08B 21/02; B25F 5/00
USPC ..... 340/6.1
See application file for complete search history.

(56) References Cited

U.S. PATENT DOCUMENTS

| | | | | |
|---|---|---|---|---|
| 10,104,507 | B1 * | 10/2018 | Pinder | H04W 4/025 |
| 2004/0088780 | A1 * | 5/2004 | Bachar | A62B 17/001 2/457 |
| 2005/0128083 | A1 * | 6/2005 | Puzio | G08B 13/2462 340/5.2 |

(Continued)

FOREIGN PATENT DOCUMENTS

| | | | |
|---|---|---|---|
| JP | H06-180792 | A | 6/1994 |
| JP | 2000-178810 | A | 6/2000 |

(Continued)

OTHER PUBLICATIONS

Nov. 24, 2020 Office Action issued in Japanese Patent Application No. 2017-137349.

(Continued)

*Primary Examiner* — Zhen Y Wu
(74) *Attorney, Agent, or Firm* — Oliff PLC

(57) ABSTRACT

A garment includes a garment body, a wear detection device configured to detect whether the garment body is worn by a worker, and a control device configured to output an alert signal for controlling an alert device based on detection data of the wear detection device.

22 Claims, 16 Drawing Sheets

(56) References Cited

U.S. PATENT DOCUMENTS

| | | | | |
|---|---|---|---|---|
| 2006/0179473 | A1* | 8/2006 | Innami | B25F 5/00 726/2 |
| 2008/0056508 | A1* | 3/2008 | Pierce | H04R 5/02 381/87 |
| 2015/0109123 | A1* | 4/2015 | Ros | G08B 25/016 340/539.11 |
| 2015/0277428 | A1* | 10/2015 | Dackefjord | G07C 3/04 700/180 |
| 2017/0014984 | A1 | 1/2017 | Rola et al. | |
| 2017/0014986 | A1* | 1/2017 | Chou | A01B 1/16 |
| 2017/0110006 | A1* | 4/2017 | Yamamoto | F16P 3/00 |
| 2017/0149933 | A1* | 5/2017 | Lee | H04L 67/306 |
| 2017/0196513 | A1* | 7/2017 | Longinotti-Buitoni | A61B 5/7405 |
| 2017/0248272 | A1* | 8/2017 | Ullrich | F16P 3/14 |
| 2019/0000675 | A1* | 1/2019 | DaRosa | G02C 1/00 |
| 2019/0120427 | A1* | 4/2019 | Dolivo | H02H 1/0007 |
| 2019/0279490 | A1* | 9/2019 | Kitada | G08B 21/0275 |
| 2021/0283761 | A1* | 9/2021 | Schadow | A41D 1/002 |

FOREIGN PATENT DOCUMENTS

| | | | |
|---|---|---|---|
| JP | 2002-518650 | A | 6/2002 |
| JP | 3334872 | B2 | 10/2002 |
| JP | 2006-218575 | A | 8/2006 |
| JP | 2008-065720 | A | 3/2008 |
| JP | 2008-146301 | A | 6/2008 |
| JP | 2008-165672 | A | 7/2008 |
| JP | 2009-191420 | A | 8/2009 |
| JP | 2011-067911 | A | 4/2011 |
| JP | 2013-066949 | A | 4/2013 |
| JP | 5537106 | B2 | 7/2014 |
| JP | 2016-508074 | A | 3/2016 |
| JP | 2017-036535 | A | 2/2017 |
| JP | 2017-074662 | A | 4/2017 |
| JP | 2017-114652 | A | 6/2017 |
| WO | 2016/062423 | A1 | 4/2016 |

OTHER PUBLICATIONS

Fujikawa et al.; "Design and Evaluation of the Detection System for Uniform Dressing Undressing Using Intra-Body Communication Technology", Int. J. of Safety and Security Eng.; 2013; pp. 1-9; vol. 3, No. 1.

Aug. 21, 2018 Search Report issued in International Patent Application No. PCT/JP2018/019687.

Mar. 29, 2022 Office Action issued in Japanese Patent Application No. 2021-060663.

* cited by examiner

GARMENT AND ALERT SYSTEM

FIELD

The present invention relates to a garment and an alert system.

BACKGROUND

In worksites, work is carried out with safety ensured. Patent Literature 1 discloses a technique that issues a warning by a warning tool when a worker is present in the direction in which timber falls in logging operation.

CITATION LIST

Patent Literature

Patent Literature 1: Japanese Patent Application Laid-open No. 2008-065720

SUMMARY

Technical Problem

In a work site, if a worker does not wear designated clothing, the workability may be reduced or an unexpected event may occur. A third person such as another worker or a supervisor may be present around the worker who carries out work. The workability may be reduced or an unexpected event may occur also when a third person approaches the worker at work.

An aspect of the present invention has an object to provide a garment and an alert system that are capable of maintaining a good work environment in worksites.

Solution to Problem

According to a first aspect of the present invention, a garment includes: a garment body; a wear detection device configured to detect whether the garment body is worn by a worker; and a control device configured to output an alert signal for controlling an alert device based on detection data of the wear detection device.

According to a second aspect of the present invention, a garment includes: a garment body; a wear detection device configured to detect whether the garment body is worn by a worker; a garment communication device configured to communicate with a power tool; and a control device configured to output a tool signal for controlling the power tool based on detection data of the wear detection device.

According to a third aspect of the present invention, a garment includes: a garment body; a garment communication device configured to communicate with external communication equipment when the garment body is worn by a worker; and a control device configured to output an alert signal for controlling an alert device based on distance data indicating a distance from the external communication equipment acquired through communication with the external communication equipment.

According to a fourth aspect of the present invention, a garment includes: a garment body to be worn by a worker; a garment communication device configured to communicate with external communication equipment when a power tool held by the worker is activated; and a control device configured to output an alert signal for controlling an alert device based on distance data indicating a distance from the external communication equipment acquired through communication with the external communication equipment.

According to a fifth aspect of the present invention, a garment includes: a garment body; a garment communication device configured to communicate with a power tool; and a control device configured to output an alert signal for controlling an alert device based on tool data indicating a state of the power tool acquired through communication with the power tool.

According to a sixth aspect of the present invention, a garment includes: a garment body; a garment communication device configured to communicate with a power tool when the garment body is worn by a worker; and a control device configured to output a tool signal for controlling the power tool after start of communication with the power tool and to output an alert signal for controlling an alert device based on tool data indicating a state of the power tool acquired through communication with the power tool.

According to a seventh aspect of the present invention, a garment includes: a garment body; an adapter to which a power tool battery is attached; a garment communication device configured to communicate with a power tool when the power tool battery is attached to the adapter; and a control device configured to output an alert signal for controlling an alert device based on tool data indicating a state of the power tool acquired through communication with the power tool.

According to an eighth aspect of the present invention, an alert system includes: external communication equipment configured to communicate with the garment according to any one of claims 1 to 34; and an alert device configured to be activated based on an alert signal from the garment.

Advantageous Effects of Invention

An aspect of the present invention provides a garment and an alert system that are capable of maintaining a good work environment in worksites.

DESCRIPTION OF EMBODIMENTS

Although embodiments of the present invention will be described below with reference to the drawings, the present invention is not limited thereto. The components in the embodiments described below can be combined as appropriate. Some of the components are not used in some cases.

First Embodiment

Figure 1:
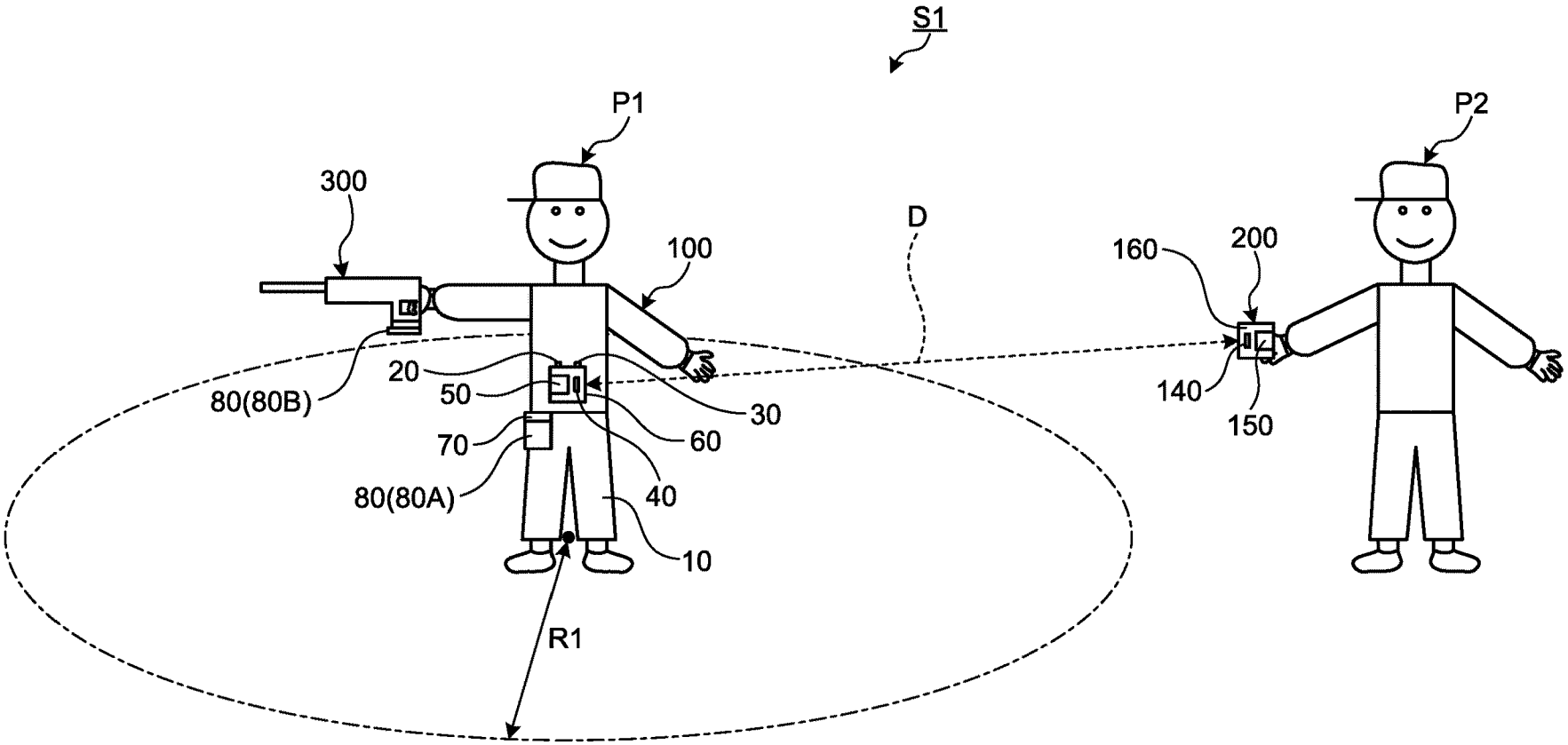
FIG. 1 is a diagram schematically illustrating an example of an alert system according to a first embodiment.

FIG. 1 is a diagram schematically illustrating an example of an alert system S1 according to the present embodiment. As illustrated in FIG. 1, a worker P1 who carries out work and a third person P2 are present in a worksite. The worksite may be outdoor or indoor. The third person P2 includes another worker or a supervisor. The alert system S1 includes a garment 100 worn by the worker P1 and external communication equipment 200 carried by the third person P2. The external communication equipment 200 communicates with the garment 100.

The alert system S1 notifies at least one of the worker P1 and the third person P2 as necessary that the worker P1 carrying out work while wearing the garment 100 and the third person P2 carrying the external communication equipment 200 approach each other.

The garment 100 includes: a garment body 10, a garment communication device 40 communicating with the external communication equipment 200; an alert device 50; and a control device 60 connected to each of the garment communication device 40 and the alert device 50. Each of the garment communication device 40, the alert device 50, and the control device 60 are removably provided to the garment body 10.

The garment 100 further includes a wear detection device 20 detecting whether the garment body 10 is worn by the worker P1 and a position detection device 30 detecting the position of the garment body 10. Each of the wear detection device 20 and the position detection device 30 is connected to the control device 60. Each of the wear detection device 20 and the position detection device 30 is removably provided to the garment body 10.

The external communication equipment 200 includes: an external communication device 140 communicating with the garment 100; an alert device 150; and a control device 160 connected to each of the external communication device 140 and the alert device 150.

In the present embodiment, the worker P1 carries out work using a power tool 300. The power tool 300 has a blade and an actuator driving the blade. Examples of the power tool 300 include chain saws, grass trimmers, electric drills, nailers, hammers, hedge trimmers, grinders, disc saws, other power tools, and gardening tools.

A power tool battery 80B is attached to the power tool 300. The power tool 300 is activated by power supplied from the power tool battery 80B.

The garment 100 includes an adapter 70 to which the power tool battery 80A is attached. The power tool battery 80A is removably attached to the adapter 70. The adapter 70 is removably provided to the garment body 10. Electronic equipment provided on the garment body 10 is activated by power supplied from the power tool battery 80A. In the present embodiment, the electronic equipment provided to the garment body 10 includes at least one of the wear detection device 20, the position detection device 30, the garment communication device 40, the alert device 50, and the control device 60.

The power tool battery 80A and the power tool battery 80B are of the same type. In the following description, the power tool battery 80A and the power tool battery 80B are collectively referred to as power tool battery 80 as appropriate. The garment 100 can share the power tool battery 80 with the power tool 300. In other words, the power tool battery 80 can be attached to each of the adapter 70 provided to the garment 100 and the power tool 300.

Garment

Figure 2:
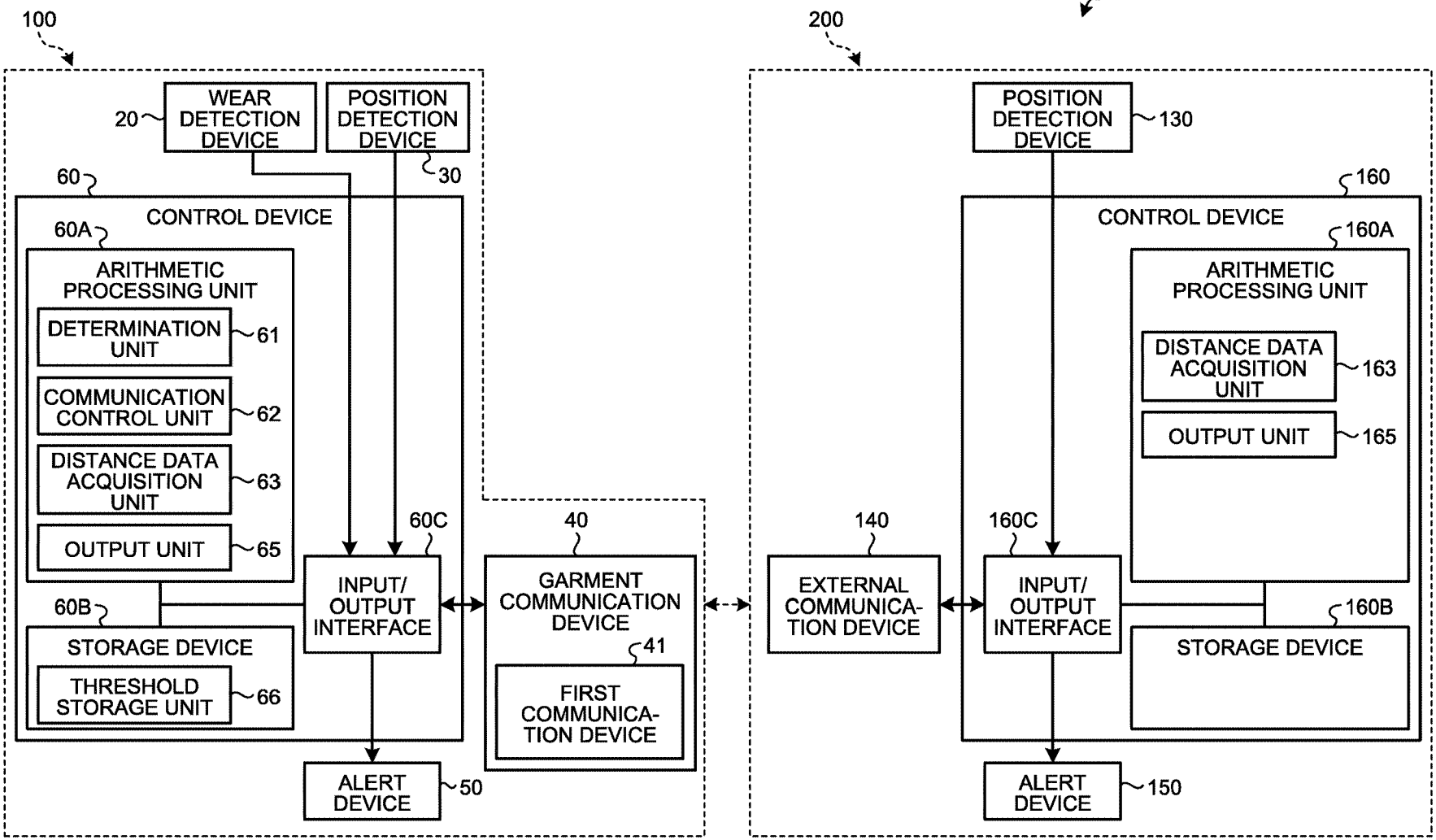
FIG. 2 is a functional block diagram illustrating an example of the alert system according to the first embodiment.

FIG. 2 is a functional block diagram illustrating an example of the alert system S1 according to the present embodiment. As illustrated in FIG. 1 and FIG. 2, the garment 100 includes the wear detection device 20, the position detection device 30, the garment communication device 40, the alert device 50, and the control device 60.

The garment body 10 is worn by the worker P1. The garment body 10 is formed of cloth. Each of the wear detection device 20, the position detection device 30, the garment communication device 40, the alert device 50, and the control device 60 is removably provided to the garment body 10. Each of the wear detection device 20, the position detection device 30, the garment communication device 40, the alert device 50, and the control device 60 can be detached from the garment body 10 so that the garment body 10 is washed.

The wear detection device 20 detects whether the garment body 10 is worn by the worker P1. The wear detection device 20 includes a biometric sensor. When the garment body 10 is worn by the worker P1, the wear detection device 20 detects a biometric signal indicating heart rate, breathing, body movement, electromyogram, perspiration, body temperature, and capacitance of the worker P1, and any other states of the worker P1. The biometric sensor can detect a wear state in which the garment body 10 is worn by the worker P1 and a non-wear state in which the garment body 10 is not worn by the worker P1. The detection data of the wear detection device 20 includes detection data indicating that the garment body 10 is in the wear state and detection data indicating the non-wear state. The detection data of the wear detection device 20 is output to the control device 60.

The position detection device 30 detects first position data indicating the position of the garment body 10. The position detection device 30 detects the position of the garment body 10 using global navigation satellite system (GNSS). Global navigation satellite system includes global positioning system (GPS). The position detection device 30 includes a GPS sensor. The position detection device 30 receives signals from a plurality of GPS satellites and detects the position of the garment body 10 in a global coordinate system. The first position data detected by the position detection device 30 includes coordinates data of latitude, longitude, and altitude of the garment body 10. The detection data of the position detection device 30 includes the first position data. The detection data of the position detection device 30 is output to the control device 60.

The garment communication device 40 has a first communication device 41 communicating with the external communication device 140 of the external communication equipment 200. The garment communication device 40 receives communication data from the external communication equipment 200 and outputs the received communication data to the control device 60. The garment communication device 40 also transmits communication data from the control device 60 to the external communication equipment 200. In the present embodiment, the garment communication device 40 wirelessly communicates with the external communication equipment 200. The garment communication device 40 may communicate with the external communication equipment 200 by wire.

The alert device 50 outputs alert data. The alert device 50 is controlled by the control device 60. The control device 60 outputs an alert signal, which is a command signal for controlling the alert device 50. The alert device 50 is activated based on the alert signal output from the control device 60.

The alert signal includes an alert signal for activating the alert device 50 to output alert data from the alert device 50 and an alert signal for stopping activation of the alert device 50 to stop output of alert data from the alert device 50.

An example of the alert data output from the alert device 50 is at least one of sound, vibration, smell, and light. An example of the alert device 50 is at least one of a buzzer outputting sound, a vibration mechanism outputting vibration, an olfactory display outputting smell, and a warning light outputting light.

The control device 60 outputs an alert signal for controlling the alert device 50 based on detection data of the wear detection device 20. The control device 60 also outputs an alert signal for controlling the alert device 50 based on a communication state of the first communication device 41. The control device 60 also outputs a control signal for controlling the alert device 50 based on detection data of the position detection device 30. In the present embodiment, the control device 60 outputs an alert signal for controlling the alert device 50 based on distance data indicating a distance D from the external communication equipment 200 acquired through communication with the external communication equipment 200.

The control device 60 includes a computer system. The control device 60 includes an arithmetic processing unit 60A including a processor such as a central processing unit (CPU), a storage device 60B including a nonvolatile memory such as a random access memory (RAM) and a volatile memory such as a read only memory (ROM), and an input/output interface 60C.

The arithmetic processing unit 60A has a determination unit 61, a communication control unit 62, a distance data acquisition unit 63, and an output unit 65.

The determination unit 61 determines whether the garment body 10 is worn by the worker P1, based on detection data of the wear detection device 20. When a biometric signal is acquired from the wear detection device 20, the determination unit 61 determines that the garment body 10 is worn by the worker P1, that is, in the wear state. When a biometric signal is not acquired from the wear detection device 20, the determination unit 61 determines that the garment body 10 is not worn by the worker P1, that is, in the non-wear state.

The determination unit 61 determines whether the first communication device 41 is in communication with the external communication equipment 200 based on the communication state of the first communication device 41. The determination unit 61 determines that the first communication device 41 is in communication with the external communication equipment 200 when a permission response is received from the external communication device 140 when the first communication device 41 makes a connection request to the external communication device 140. The determination unit 61 determines that the first communication device 41 is not in communication with the external communication equipment 200 when a denial response is received from the external communication device 140 or when no response is received for a prescribed time when the first communication device 41 makes a connection request to the external communication device 140.

The communication control unit 62 controls the garment communication device 40 to start communication with the external communication equipment 200.

The distance data acquisition unit 63 calculates distance data indicating the distance D between the garment 100 and the external communication equipment 200, based on data for distance calculation acquired through communication with the external communication equipment 200, after the start of communication between the garment communication device 40 and the external communication equipment 200.

In the present embodiment, the distance data acquisition unit 63 acquires second position data indicating the position of the external communication equipment 200, as the data for distance calculation. The position of the external communication equipment 200 is defined in a global coordinate system. The external communication equipment 200 transmits the second position data indicating the position of the external communication equipment 200 in a global coordinate system to the control device 60. The distance data acquisition unit 63 acquires the second position data from the external communication equipment 200.

The distance data acquisition unit 63 also acquires the first position data indicating the position of the garment 100. The position of the garment 100 is defined in a global coordinate system. The first position data is detected by the position detection device 30. The position detection device 30 outputs the first position data indicating the position of the garment 100 in a global coordinate system to the control device 60. The distance data acquisition unit 63 acquires the first position data from the position detection device 30.

The distance data acquisition unit 63 calculates distance data indicating the distance D between the garment 100 and the external communication equipment 200, based on the first position data output from the position detection device 30 and the second position data transmitted from the external communication equipment 200. The distance data acquisition unit 63 can acquire the distance data between the garment 100 and the external communication equipment 200 in a global coordinate system, based on the first position data of the garment body 10 in a global coordinate system and the second position data of the external communication equipment 200 in a global coordinate system.

The output unit 65 outputs an alert signal for controlling the alert device 50, based on detection data of the wear detection device 20. In the present embodiment, the output unit 65 outputs an alert signal for activating the alert device 50 when the determination unit 61 determines that the garment body 10 is not worn by the worker P1, based on detection data of the wear detection device 20.

The output unit 65 also outputs an alert signal for controlling the alert device 50, based on a communication state of the first communication device 41. In the present embodiment, the output unit 65 outputs an alert signal for activating the alert device 50 when the determination unit 61 determines that the first communication device 41 is unable to communicate with the external communication equipment 200, based on a communication state of the first communication device 41.

The output unit 65 also outputs an alert signal for controlling the alert device 50, based on the distance data indicating the distance D between the garment 100 and the external communication equipment 200. In the present embodiment, the output unit 65 outputs an alert signal for activating the alert device 50 when the distance D between the garment 100 and the external communication equipment 200 is equal to or smaller than a first threshold R1. The output unit 65 outputs an alert signal for stopping activation of the alert device 50 when the distance D between the garment 100 and the external communication equipment 200 is greater than the first threshold R1.

The storage device 60B has a threshold storage unit 66 storing therein first threshold data indicating the first threshold R1. The first threshold R1 is a predetermined value for the distance D between the garment body 10 and the external communication equipment 200 and stored in the threshold storage unit 66.

The first threshold R1 may be set based on the worksite at which the worker P1 performs work. When the worksite is outdoor, the first threshold R1 is set, for example, in a range of 3 [m] to 10 [m]. When the worksite is indoor, the first threshold R1 is set, for example, in a range of 1 [m] to 5 [m].

External Communication Equipment

The external communication equipment 200 can communicate with the garment 100. The external communication equipment 200 is portable equipment that can be carried by the third person P2. The external communication equipment 200 includes a portable computer system such as smartphone or tablet personal computer.

The external communication equipment 200 includes a position detection device 130, an external communication device 140, an alert device 150, and a control device 160. The position detection device 130 detects second position data indicating the position of the external communication equipment 200. The position detection device 130 includes a GPS sensor and detects second position data indicating the position of the external communication equipment 200 in a global coordinate system.

The external communication device 140 transmits the second position data detected by the position detection device 130 to the garment communication device 40. The external communication device 140 receives the first position data detected by the position detection device 30 from the garment communication device 40.

The alert device 150 outputs alert data. The alert device 150 is controlled by the control device 160. The control device 160 outputs an alert signal, which is a command signal for controlling the alert device 150. The alert device 150 is activated based on the alert signal output from the control device 160. An example of the alert data output from the alert device 150 is at least one of sound, vibration, smell, and light. An example of the alert device 150 is at least one of a buzzer outputting sound, a vibration mechanism outputting vibration, an olfactory display outputting smell, and a warning light outputting light.

The control device 160 controls the alert device 150, based on communication data transmitted from the garment 100. The communication data transmitted from the garment 100 includes detection data of the wear detection device 20. The control device 160 outputs an alert signal for controlling the alert device 150 based on detection data of the wear detection device 20. The control device 160 also outputs an alert signal for controlling the alert device 150 based on a communication state between the first communication device 41 and the external communication device 140. The control device 160 also outputs a control signal for controlling the alert device 50 based on detection data of the position detection device 130. In the present embodiment, the control device 160 outputs an alert signal for controlling the alert device 150 based on distance data indicating the distance D.

The control device 160 includes an arithmetic processing unit 160A including a processor such as a CPU, a storage device 160B including a nonvolatile memory such as a RAM and a volatile memory such as a ROM, and an input/output interface 160C. The arithmetic processing unit 160A has a distance data acquisition unit 163 and an output unit 165.

The distance data acquisition unit 163 calculates distance data indicating the distance D between the garment 100 and the external communication equipment 200, based on data for distance calculation acquired through communication with the garment 100. The distance data acquisition unit 163 acquires first position data transmitted from the garment 100, as the data for distance calculation. The distance data acquisition unit 163 also acquires detection data of the position detection device 130. The detection data of the position detection device 130 includes second position data indicating the position of the external communication equipment 200.

The distance data acquisition unit 163 calculates the distance D between the garment 100 and the external communication equipment 200 in a global coordinate system, based on the first position data transmitted from the garment 100 and the second position data output from the position detection device 130.

The output unit 165 outputs an alert signal for controlling the alert device 150, based on detection data of the wear detection device 20 transmitted from the garment 100. In the present embodiment, the output unit 165 outputs an alert signal for activating the alert device 150 when it is determined that the garment body 10 is not worn by the worker P1, based on detection data of the wear detection device 20.

The output unit 165 also outputs an alert signal for controlling the alert device 150, based on a communication state between the first communication device 41 of the garment communication device 40 and the external communication device 140. In the present embodiment, the output unit 165 outputs an alert signal for activating the alert device 150 when it is determined that the first communication device 41 and the external communication equipment 200 are unable to communicate with each other, based on a communication state between the first communication device 41 and the external communication device 140.

The output unit 165 also outputs an alert signal for controlling the alert device 150, based on distance data indicating the distance D between the garment 100 and the external communication equipment 200. In the present embodiment, the output unit 165 outputs an alert signal for activating the alert device 150 when the distance D between the garment 100 and the external communication equipment 200 is equal to or smaller than the first threshold R1. The output unit 165 outputs an alert signal for stopping activation of the alert device 150 when the distance D between the garment 100 and the external communication equipment 200 is greater than the first threshold R1.

Adapter

Figure 3:
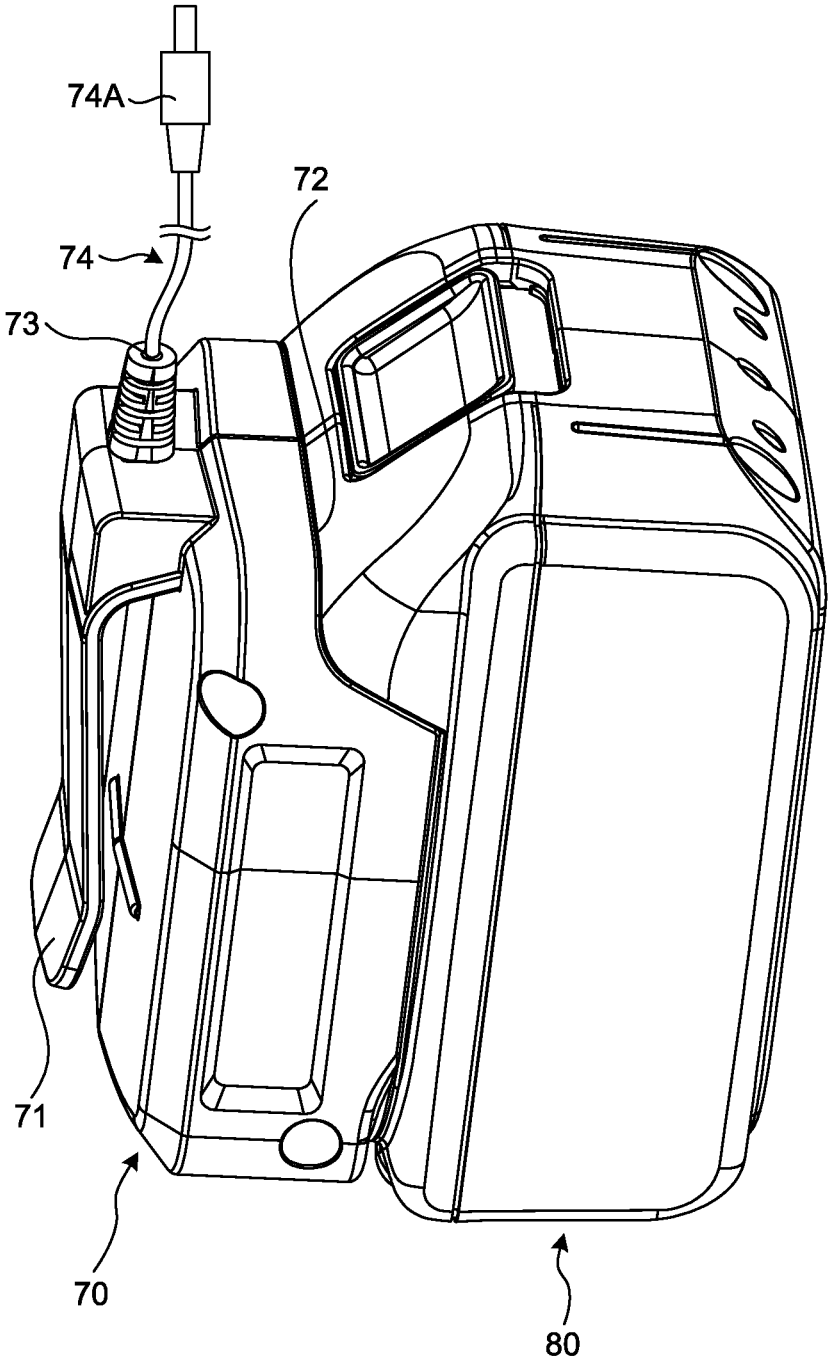
FIG. 3 is a perspective view illustrating an example of an adapter and a power tool battery according to the first embodiment.
Figure 4:
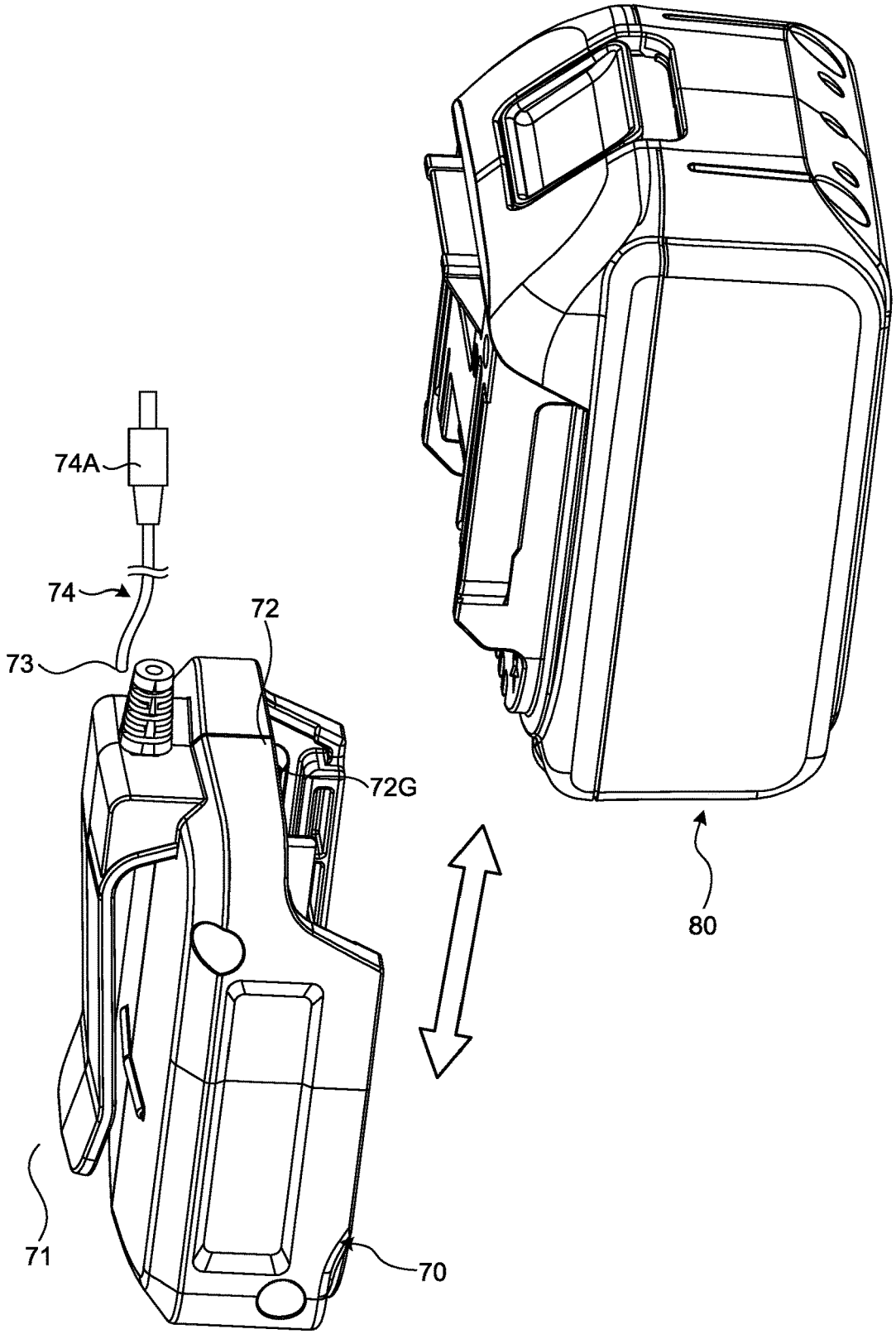
FIG. 4 is a perspective view illustrating an example of the adapter and the power tool battery according to the first embodiment.

FIG. 3 and FIG. 4 are perspective views illustrating an example of the adapter 70 and the power tool battery 80 according to the present embodiment. FIG. 3 illustrates the power tool battery 80 attached to the adapter 70. FIG. 4 illustrates the power tool battery 80 detached from the adapter 70.

The adapter 70 is removably attached to the garment body 10. The adapter 70 has a fixed part 71 fixed to the garment body 10, a battery attachment part 72 to which the power tool battery 80 is attached, and a connection part 73 to which a cable 74 is connected.

The fixed part 71 is hooked to at least a part of the garment body 10 and thereby fixed to the garment body 10. The fixed part 71 is fixed to the garment body 10, whereby the adapter 70 is attached to the garment body 10. The fixed part 71 is released from the garment body 10, whereby the adapter 70 is detached from the garment body 10.

The battery attachment part 72 is joined to the power tool battery 80. The power tool battery 80 is a rechargeable battery. The power tool battery 80 is attached to the battery attachment part 72. The battery attachment part 72 has a guide 72G to guide the power tool battery 80. The power tool battery 80 slides on the battery attachment part 72 while being guided by the guide 72G and thereby is attached to the battery attachment part 72. Attaching the power tool battery 80 to the adapter 70 allows the adapter 70 and the power tool battery 80 to be electrically connected with each other.

The connection part 73 is connected to the cable 74. With the power tool battery 80 attached to the adapter 70, the cable 74 and the connection part 73 are connected. A terminal 74A of the cable 74 is connected to a power supply target. In the present embodiment, the power supply target includes the electronic equipment provided on the garment 100 and the power tool 300.

With the power tool battery 80A attached to the adapter 70, the cable 74 is connected with the connection part 73, and the terminal 74A of the cable 74 is connected with the electronic equipment provided on the garment 100, whereby power is supplied from the power tool battery 80A to the electronic equipment. As described above, the electronic equipment of the garment 100 includes at least one of the wear detection device 20, the position detection device 30, the garment communication device 40, the alert device 50, and the control device 60.

Attaching the power tool battery 80B to the power tool 300 brings the power tool 300 into an activation-enabled state. When the power tool battery 80B is attached to the power tool 300 and the main power supply of the power tool 300 is turned on or a trigger switch (operating switch) provided on the power tool 300 is operated, the power tool 300 is activated. In the present embodiment, the wording "when the power tool 300 is activated" refers to when the main power supply of the power tool 300 is turned on or when the trigger switch provided on the power tool 300 is operated.

Figure 5:
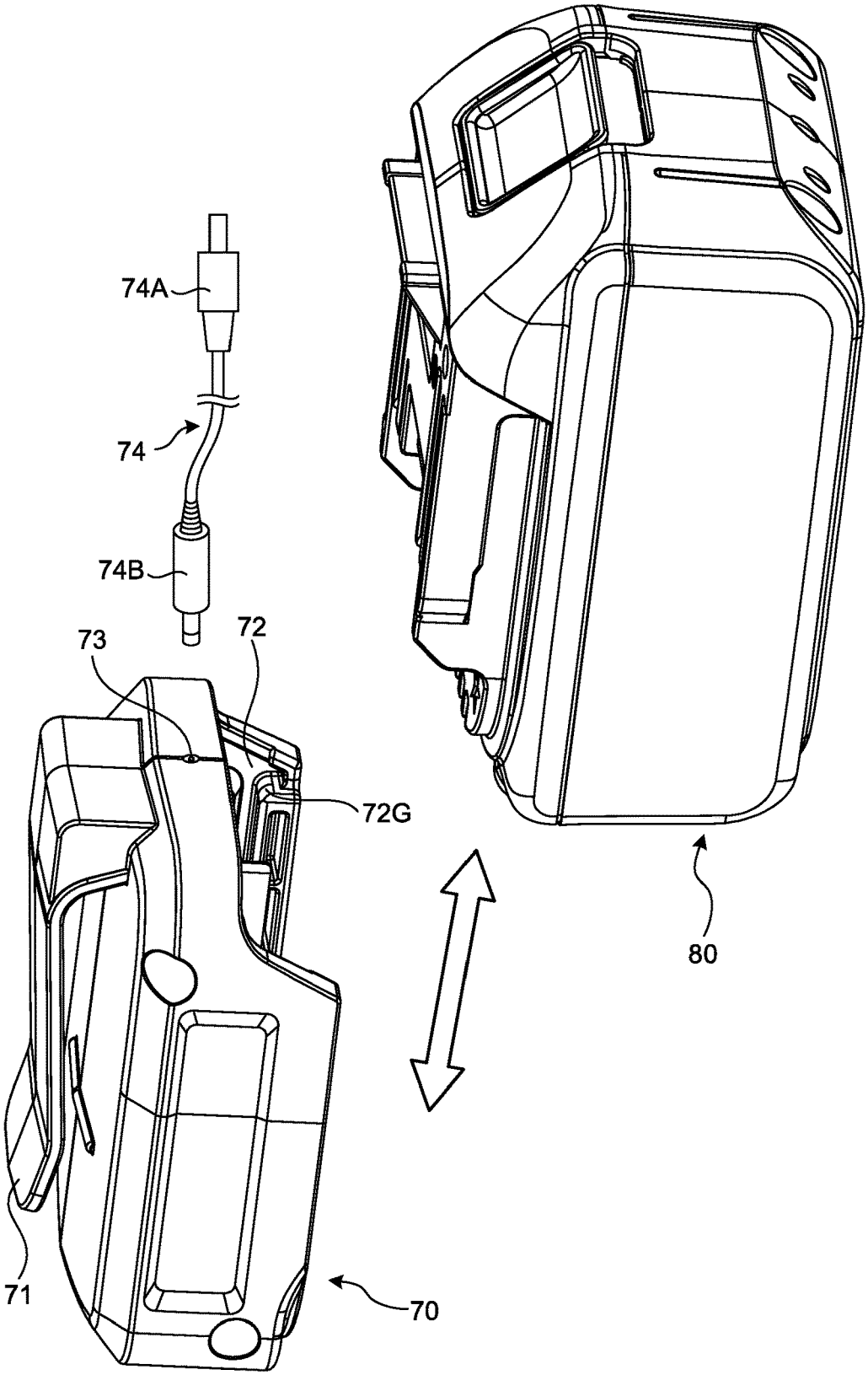
FIG. 5 is a perspective view illustrating an example of the adapter and the power tool battery according to the first embodiment.

FIG. 5 is a perspective view illustrating another example of the adapter 70 and the power tool battery 80 according to the present embodiment. FIG. 5 illustrates the power tool battery 80 detached from the adapter 70.

The adapter 70 has a fixed part 71 fixed to the garment body 10, a battery attachment part 72 to which the power tool battery 80 is attached, and a connection part 73. The connection part 73 includes a depression provided at a part of the adapter 70. The connection part 73 is connected to one terminal 74B of the cable 74. The terminal 74B is removably connected to the connection part 73. With the power tool battery 80 attached to the adapter 70, one terminal 74B of the cable 74 is connected to the connection part 73. The other terminal 74A of the cable 74 is connected to a power supply target.

Operation of Alert System

Figure 6:
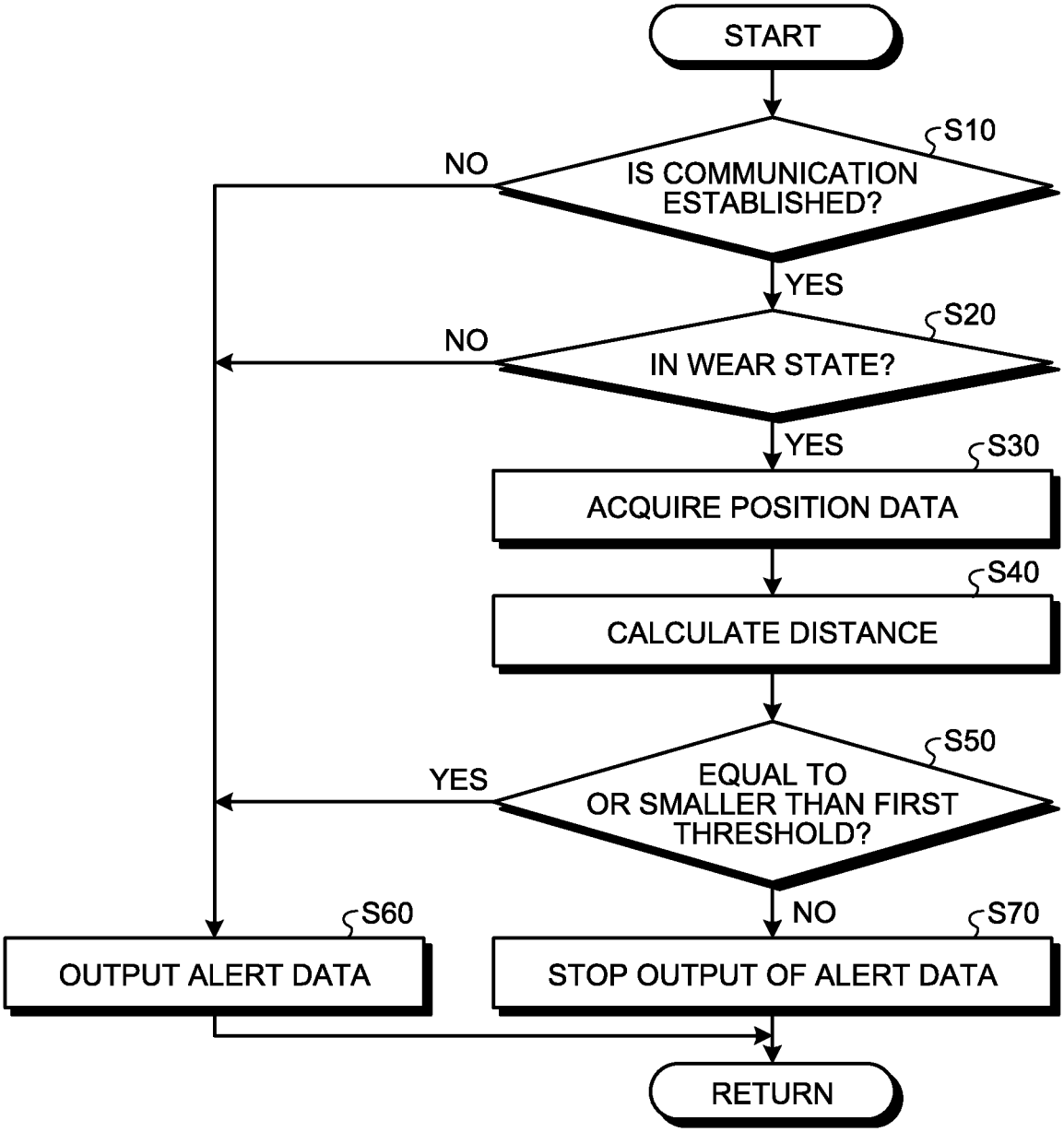
FIG. 6 is a flowchart illustrating an example of the operation of a garment according to the first embodiment.

An example of the operation of the alert system S1 according to the present embodiment will now be described. FIG. 6 is a flowchart illustrating an example of the operation of the garment 100 according to the present embodiment. The process described with reference to FIG. 6 is performed at prescribed intervals.

In the present embodiment, the garment 100 used in a worksite is designated by the third person P2 (for example, supervisor). The third person P2 can operate an operating device of the external communication equipment 200 to designate a garment 100 to be used in the worksite, for example, from among a plurality of garments 100 stored in a storage space in the worksite. Identification data is allocated to the garment 100. The identification data of the garment 100 is stored (registered) in the storage device 160B of the external communication equipment 200. The third person P2 can designate a garment 100 to be used in the worksite by operating the operating device of the external communication equipment 200 to designate the identification data. When the external communication equipment 200 is a portable computer system, an example of the operating device of the external communication equipment 200 is at least one of a computer keyboard, a mouse, and a touch panel.

The worker P1 attaches the power tool battery 80A to the adapter 70 of the garment 100. When there are a plurality of garments 100 designated to be used in a worksite and there are a plurality of workers P1 who work in the worksite, each of the workers P1 attaches the power tool battery 80A to the adapter 70 of the garment 100 to be worn by the worker P1.

In the garment 100, the power tool battery 80A is attached to the adapter 70, whereby each of the wear detection device 20, the position detection device 30, the garment communication device 40, the alert device 50, and the control device 60 is started by power supplied from the power tool battery 80A. The wear detection device 20 detects a biometric signal. The position detection device 30 detects first position data. The first communication device 41 of the garment communication device 40 makes a connection request to the external communication equipment 200.

The determination unit 61 determines whether communication between the first communication device 41 and the external communication equipment 200 is established (step S10).

At step S10, when it is determined that the first communication device 41 is unable to communicate with the external communication equipment 200 (No at step S10), the output unit 65 outputs an alert signal for activating the alert device 50 to the alert device 50. The alert device 50 outputs alert data including at least one of sound, vibration, smell, and light, based on the acquired alert signal (step S60).

In the present embodiment, when communication between the external communication equipment 200 and some garments 100 of a plurality of garments 100 designated to be used in the worksite fails to be established, all of the alert devices 50 of the garments 100 that have established communication and the alert devices 50 of the garments 100 that have failed to establish communication are activated. That is, all of the alert devices 50 of a plurality of garments 100 designated by the third person P2 are activated. When communication between the external communication equipment 200 and some garments 100 of a plurality of garments 100 designated to be used in a worksite fails to be established, the alert device 150 of the external communication equipment 200 may be activated.

When communication between the external communication equipment 200 and some garments 100 of a plurality of garments 100 designated to be used in the worksite fails to be established, the alert device 50 of a garment 100 that fails to establish communication may be activated while the alert device 50 of a garment 100 that has established communication may not necessarily be activated. When communication between the external communication equipment 200 and some garments 100 of a plurality of garments 100 designated to be used in a worksite fails to be established, the alert device 150 of the external communication equipment 200 may be activated.

At step S10, when it is determined that communication between the first communication device 41 and the external communication equipment 200 is established (Yes at step S10), the determination unit 61 determines whether the garment body 10 is worn by the worker P1, that is, in the wear state, based on detection data of the wear detection device 20 (step S20).

In the present embodiment, the determination unit 61 determines that the garment body 10 is in the wear state when the control device 60 acquires the detection data indicating that the garment body 10 is in the wear state from the wear detection device 20 when the power tool battery 80A is attached to the adapter 70 and the elapsed time since each of the wear detection device 20 and the control device 60 is started is equal to or smaller than a predetermined value. On the other hand, the determination unit 61 determines that the garment body 10 is not in the wear state when the control device 60 fails to acquire the detection data indicating that the garment body 10 is in the wear state from the wear detection device 20 although the elapsed time since each of the wear detection device 20 and the control device 60 is started reaches a predetermined value.

At step S20, when it is determined that the garment body 10 is not in the wear state (No at step S20), the output unit 65 outputs an alert signal for activating the alert device 50 to the alert device 50 (step S60).

At step S20, when it is determined that the garment body 10 is in the wear state (Yes at step S20), the external communication equipment 200 transmits second position data indicating the position of the external communication equipment 200 detected by the position detection device 130 to the garment communication device 40 of the garment 100. The distance data acquisition unit 63 acquires the first position data detected by the position detection device 30 and the second position data detected by the position detection device 130 (step S30).

The distance data acquisition unit 63 calculates the distance D between the garment 100 and the external communication equipment 200, based on the first position data and the second position data (step S40).

The output unit 65 determines whether the distance D calculated by the distance data acquisition unit 63 is equal to or smaller than the first threshold R1 (step S50).

At step S50, when it is determined that the distance D is equal to or smaller than the first threshold R1 (Yes at step S50), the output unit 65 outputs an alert signal for activating the alert device 50 to the alert device 50. The alert device 50 outputs alert data (step S60).

At step S50, when it is determined that the distance D is not equal to or smaller than the first threshold R1 (No at step S50), the output unit 65 outputs an alert signal for stopping activation of the alert device 50. With this process, the activation of the alert device 50 is stopped, and output of alert data from the alert device 50 is stopped (step S70).

In the external communication equipment 200, a similar process is performed. More specifically, in the external communication equipment 200, the position detection device 130, the external communication device 140, the alert device 150, and the control device 160 are started. The position detection device 130 detects second position data. When communication between the first communication device 41 of the garment communication device 40 and the external communication device 140 is established other, the first communication device 41 of the garment communication device 40 transmits detection data of the wear detection device 20 and first position data detected by the position detection device 30 to the external communication equipment 200. In the external communication equipment 200, the distance data acquisition unit 163 calculates the distance D between the garment 100 and the external communication equipment 200, based on the first position data transmitted from the garment 100 and the second position data detected by the position detection device 130.

When it is determined that the garment 100 is not in the wear state, the output unit 165 of the external communication equipment 200 outputs an alert signal for activating the alert device 150. When the distance D is equal to or smaller than the first threshold R1, the output unit 165 outputs an alert signal for activating the alert device 150. When it is determined that the first communication device 41 and the external communication device 140 are unable to communicate with each other, the output unit 165 outputs an alert signal for activating the alert device 150. The alert device 150 outputs alert data including at least one of sound, vibration, smell, and light, based on the alert signal.

When a garment 100 is not in the wear state, detection data indicating the non-wear state is transmitted together with the identification data of the garment 100 from the wear detection device 20 of the garment 100 to the external communication equipment 200. The external communication equipment 200 can determine which of a plurality of garments 100 designated to be used in the worksite is in the non-wear state, based on the identification data of the garment 100 transmitted from the garment 100. The identification data of the garment 100 in the non-wear state is displayed on a display device of the external communication equipment 200, so that the third person P2 can recognize which garment 100 is in the non-wear state through the external communication equipment 200.

When there are a plurality of pieces of external communication equipment 200 in a worksite, each of the alert devices 150 of these pieces of external communication equipment 200 is activated.

Figure 7:
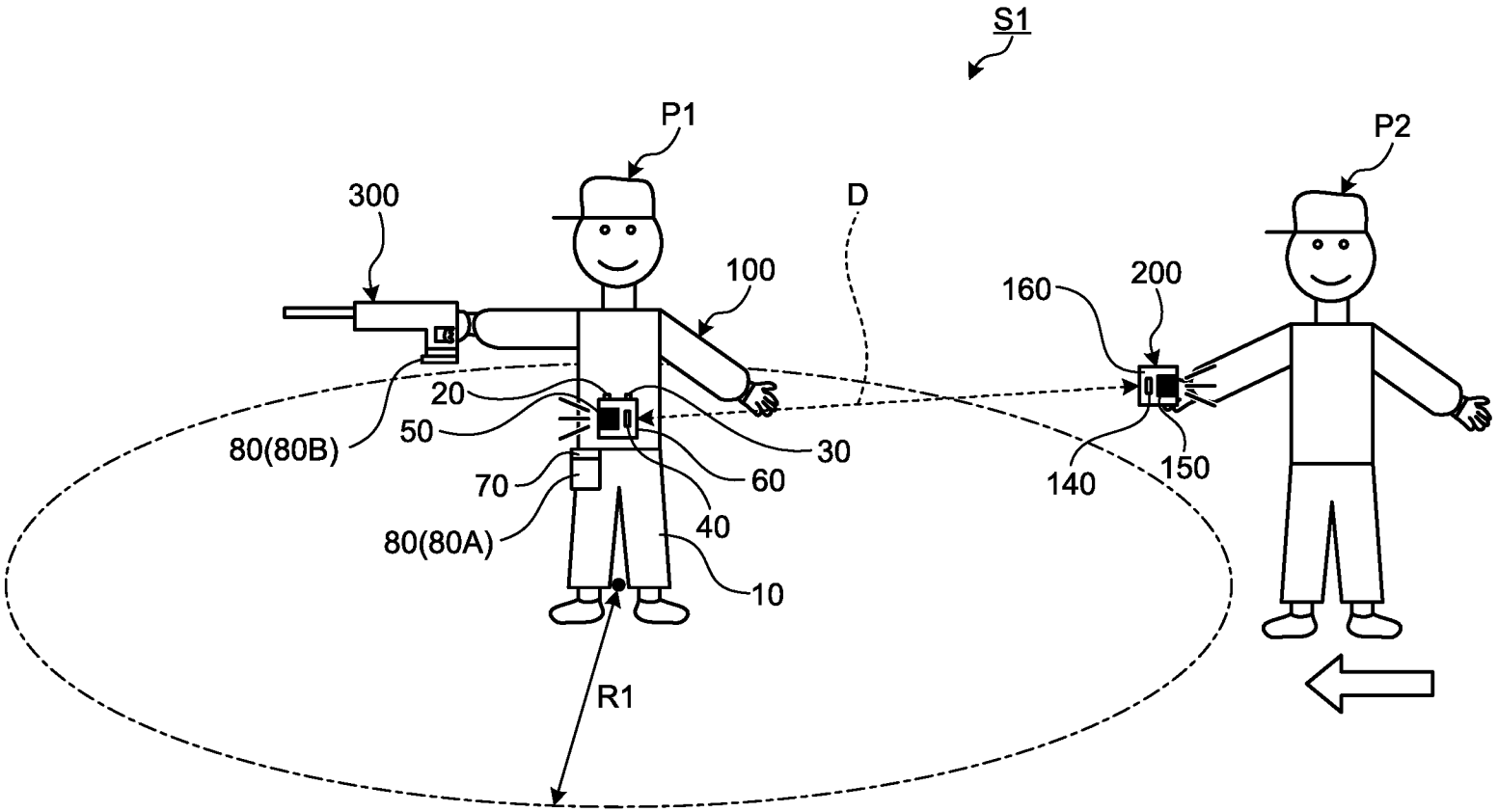
FIG. 7 is a diagram schematically illustrating a state of each of the garment and the external communication equipment when an alert signal is output in the alert system according to the first embodiment.

FIG. 7 is a diagram schematically illustrating a state of each of the garment 100 and the external communication equipment 200 when an alert signal is output in the alert system S1 according to the present embodiment. FIG. 7 illustrates an example in which the alert device 50 and the alert device 150 are activated because the distance D is equal to or smaller than the first threshold R1.

As illustrated in FIG. 7, the worker P1 carries out work using the power tool 300 while wearing the garment 100. When the third person P2 carrying the external communication equipment 200 approaches the worker P1 and the distance D between the garment 100 and the external communication equipment 200 is equal to or smaller than the first threshold R1, the alert system S1 activates each of the alert device 50 provided on the garment 100 and the alert device 150 provided on the external communication equipment 200.

The alert device 50 of the garment 100 is activated, whereby the worker P1 can be notified that the third person P2 is approaching. The alert device 150 of the external communication equipment 200 is activated, whereby the third person P2 can be notified that he/she is approaching the worker P1. In this way, when the worker P1 and the third person P2 approach each other, alert data is output for both of the worker P1 and the third person P2. The worker P1 and the third person P2 are cautioned by the alert data.

Even if the distance D is greater than the first threshold R1, as described above, the alert device 50 is activated when the garment 100 is not worn by the worker P1 or when the first communication device 41 and the external communication equipment 200 are not in communication with each other. More specifically, in the present embodiment, the alert device 50 is activated when any trouble occurs in the alert system S1.

Advantageous Effects

As explained above, according to the present embodiment, when the worker P1 is not wearing the garment 100, the alert device 50 and the alert device 150 are activated. If the worker P1 not wearing the designated garment 100 carries out work, the workability may be reduced or an unexpected event may occur. In the present embodiment, when the worker P1 is not wearing the designated garment 100, the alert device 50 is activated to allow the worker P1 to recognize that he/she is not wearing the garment 100. In addition, detection data indicating the non-wear state is transmitted together with the identification data of the garment 100 from the wear detection device 20 of the garment 100 to the external communication equipment 200. The third person P2 can recognize which of a plurality of garments 100 designated to be used in the worksite is in the non-wear state, through the external communication equipment 200. The third person P2 thus can caution the worker P1 not wearing the garment 100 to wear the garment 100. This process can prevent reduction in workability and occurrence of an unexpected event and can maintain a good work environment in worksites.

According to the present embodiment, even when communication between the first communication device 41 of the garment 100 and the external communication equipment 200 is not established, the alert device 50 and the alert device 150 are activated. When communication between the first communication device 41 of the garment 100 and the external communication equipment 200 is not established, data communication between the garment 100 and the external communication equipment 200 fails, so that the third person P2 may be unable to manage the status of the worker P1, the workability may be reduced, or an unexpected event may occur. In the present embodiment, when communication between the first communication device 41 of the garment 100 and the external communication equipment 200 is not established, the alert device 50 and the alert device 150 are activated. The worker P1 or the third person P2 therefore can recognize that communication is not established. The worker P1 or the third person P2 then can take measures to maintain a good work environment.

According to the present embodiment, when the worker P1 wearing the garment 100 and the third person P2 carrying the external communication equipment 200 approach each other, the alert device 50 and the alert device 150 are activated based on the distance D between the garment 100 and the external communication equipment 200. This allows the worker P1 and the third person P2 to recognize that the worker P1 and the third person P2 are approaching each other. The third person P2 recognizes that he/she is approaching the worker P1, whereby the third person P2 can move away from the worker P1. This can prevent reduction in workability of the worker P1. In addition, at least one of the worker P1 and the third person P2 recognizes that the worker P1 and the third person P2 are approaching each other, whereby an unexpected event can be prevented. For example, an unexpected event can be prevented also when kickback occurs, which is a phenomenon in which the power tool 300 in operation kicks back, or when at least one of the worker P1 and the third person P2 falls, suffers heat stroke, develops dehydration, or becomes fatigue. Since reduction in workability and occurrence of an unexpected event can be prevented, a good work environment can be maintained in worksites.

In the present embodiment, when the worker P1 and the third person P2 are located sufficiently far away from each other, neither the alert device 50 nor the alert device 150 is activated. This prevents alert data from being unnecessarily output from the alert device 50 and the alert device 150. If alert data is unnecessarily output from the alert device 50 and the alert device 150, the worker P1 and the third person P2 may feel discomfort. According to the present embodiment, when the distance D between the worker P1 and the third person P2 is short, alert data is output from the alert device 50 and the alert device 150, and when the distance D between the worker P1 and the third person P2 is long, alert data is not output from the alert device 50 or the alert device 150. When the worker P1 and the third person P2 approach each other, the worker P1 and the third person P2 can be cautioned as necessary so that the worker P1 and the third person P2 can recognize that the worker P1 and the third person P2 are approaching each other, while discomfort to the worker P1 and the third person P2 is reduced or eliminated.

According to the present embodiment, the garment communication device 40 communicating with the external communication equipment 200 is provided on the garment body 10. Thus, the worker P1 wears the garment 100, whereby the distance data between the worker P1 wearing the garment 100 and the third person P2 carrying the external communication equipment 200 can be acquired. A communication device for acquiring distance data from the external communication equipment 200 may be provided, for example, on the power tool 300, whereby the distance data between the worker P1 holding the power tool 300 and the third person P2 carrying the external communication equipment 200 can be acquired as well. However, when a communication device communicating with the external communication equipment 200 is provided on the power tool 300, it is necessary to provide a communication device for each of a plurality of power tools 300. As a result, the cost for the power tools 300 may be increased. According to the present embodiment, the garment communication device 40 for acquiring distance data between the worker P1 and the third person P2 is provided on the garment body 10. With this configuration, whichever power tool 300 the worker P1 uses, the worker P1 only has to wear the garment 100 so that the distance data between the worker P1 and the third person P2 can be acquired. This allows at least one of the worker P1 and the third person P2 to recognize that the worker P1 and the third person P2 are approaching, at low costs.

According to the present embodiment, distance data indicating the distance D is calculated based on the first position data detected by the position detection device 30 provided on the garment body 10 and the second position data detected by the position detection device 130 provided on the external communication equipment 200. With this configuration, the distance D is calculated with high accuracy.

According to the present embodiment, the first threshold R1 for the distance D is predetermined and stored in the threshold storage unit 66. With this configuration, activation and activation stop of the alert device 50 and the alert device 150 can be controlled based on the first threshold R1.

According to the present embodiment, each of the wear detection device 20, the position detection device 30, the garment communication device 40, the alert device 50, and the control device 60 is removably provided on the garment body 10. With this configuration, each of the wear detection device 20, the position detection device 30, the garment communication device 40, the alert device 50, and the control device 60 can be detached from the garment body 10 so that the garment body 10 is washed.

According to the present embodiment, the adapter 70 to which the power tool battery 80 is attached is provided on the garment body 10. The power tool battery 80 therefore can be used as a power supply for the wear detection device 20, the position detection device 30, the garment communication device 40, the alert device 50, and the control device 60. Since the power tool battery 80 that can be shared with the power tool 300 can be used as a power supply for the garment 100, high compatibility is achieved.

Second Embodiment

A second embodiment will now be described. In the following description, the same components as those in the foregoing embodiment are denoted by the same reference signs and a description thereof is simplified or omitted.

Alert System

Figure 8:
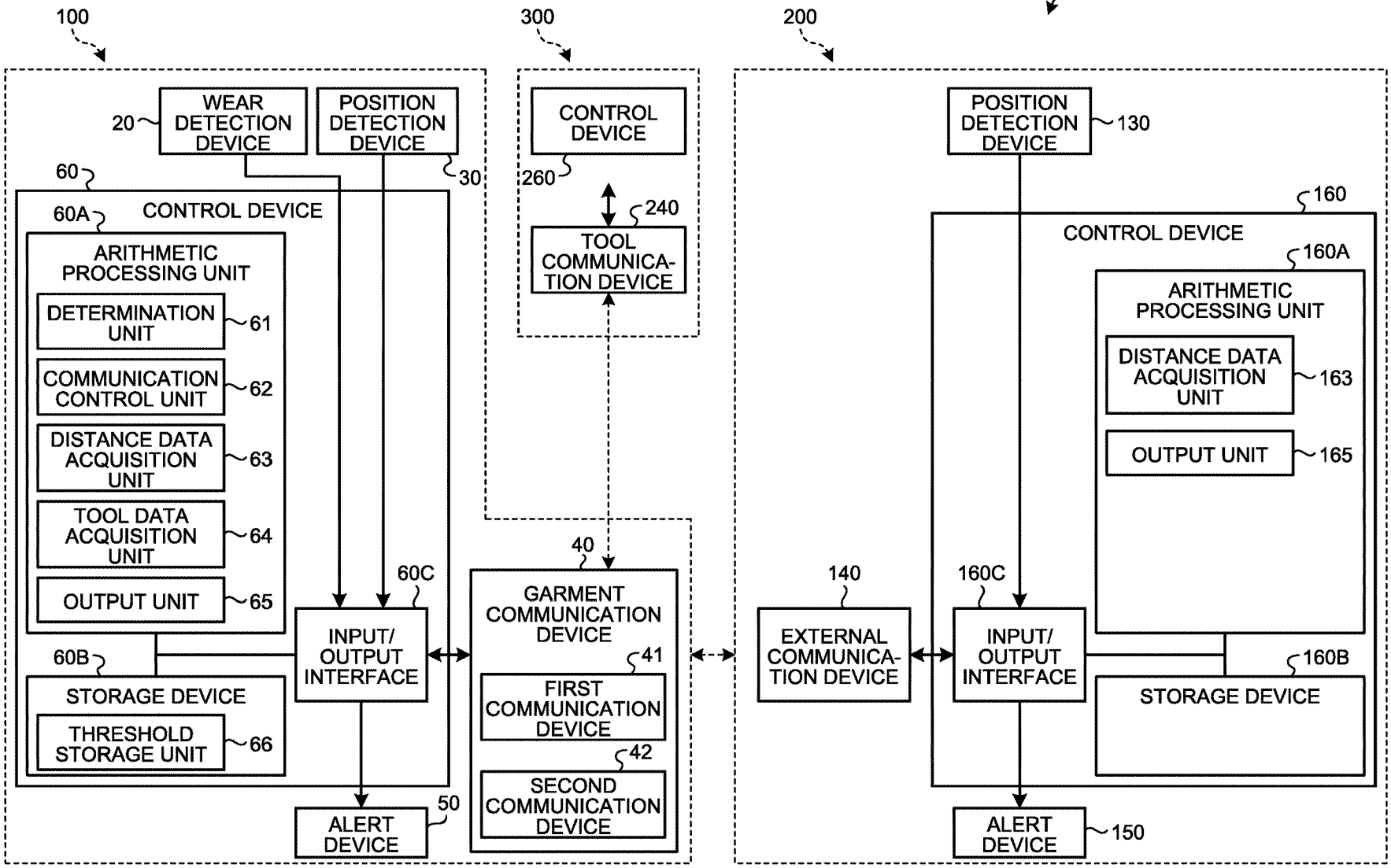
FIG. 8 is a functional block diagram illustrating an example of the alert system according to a second embodiment.

FIG. 8 is a functional block diagram illustrating an example of an alert system S2 according to the present embodiment. In the present embodiment, the garment 100 includes a second communication device 42 communicating with the power tool 300. As illustrated in FIG. 8, the power tool 300 has a tool communication device 240 and a control device 260 connected to the tool communication device 240. The second communication device 42 of the garment communication device 40 communicates with the tool communication device 240 provided on the power tool 300.

The control device 60 of the garment 100 outputs a tool signal, which is a command signal for controlling the power tool 300 based on detection data of the wear detection device 20. In the present embodiment, the control device 60 outputs a tool signal for prohibiting the activation of the power tool 300 when it is determined that the garment body 10 is not worn by the worker P1, based on detection data of the wear detection device 20.

The control device 60 outputs a tool signal for controlling the power tool 300 based on a communication state of the first communication device 41. In the present embodiment, when it is determined that the first communication device 41 is unable to communicate with the external communication equipment 200 based on a communication state of the first communication device 41, the control device 60 outputs a tool signal for prohibiting the activation of the power tool 300.

The control device 60 also outputs a tool signal for controlling the power tool 300 based on distance data indicating the distance D between the garment 100 and the external communication equipment 200. In the present embodiment, a first threshold R1 and a second threshold R2 smaller than the first threshold R1 are defined for the distance D and stored in the threshold storage unit 66. The control device 60 outputs a tool signal for prohibiting the activation of the power tool 300 when the distance D is equal to or smaller than the second threshold R2 and outputs a tool signal for permitting the activation of the power tool 300 when the distance D is greater than the second threshold R2.

The control device 60 also outputs an alert signal for controlling the alert device 50 based on the distance D. In the present embodiment, the control device 60 outputs an alert signal for activating the alert device 50 when the distance D is equal to or smaller than the first threshold R1 and is greater than the second threshold R2.

The control device 260 of the power tool 300 controls the activation state of the power tool 300. The tool signal output from the control device 60 is transmitted to the tool communication device 240 through the second communication device 42 of the garment communication device 40. The control device 260 of the power tool 300 controls the power tool 300 based on the tool signal output from the control device 60.

As in the foregoing embodiment, the wording "when the power tool 300 is activated" refers to when the main power supply of the power tool 300 is turned on or when the trigger switch provided on the power tool 300 is operated. In the activation-enabled state of the power tool 300, the power tool 300 is activated when the main power supply of the power tool 300 is turned on or when the trigger switch provided on the power tool 300 is operated by the worker P1.

In the present embodiment, the arithmetic processing unit 60A of the control device 60 has a tool data acquisition unit 64 acquiring tool data indicating a state of the power tool 300. The tool data includes tool data indicating that the trigger switch provided on the power tool 300 has been operated. When the trigger switch provided on the power tool 300 is operated, the control device 260 of the power tool 300 transmits tool data indicating that the trigger switch has been operated to the garment 100 through the tool communication device 240. When the trigger switch provided on the power tool 300 is not operated, the control device 260 of the power tool 300 transmits tool data indicating that the trigger switch is not operated to the garment 100 through the tool communication device 240. The tool data acquisition unit 64 can acquire tool data from the power tool 300 through communication between the garment communication device 40 and the tool communication device 240. The tool data may be tool data indicating that the main power supply of the power tool 300 has been turned on.

Operation of Alert System

Figure 9:
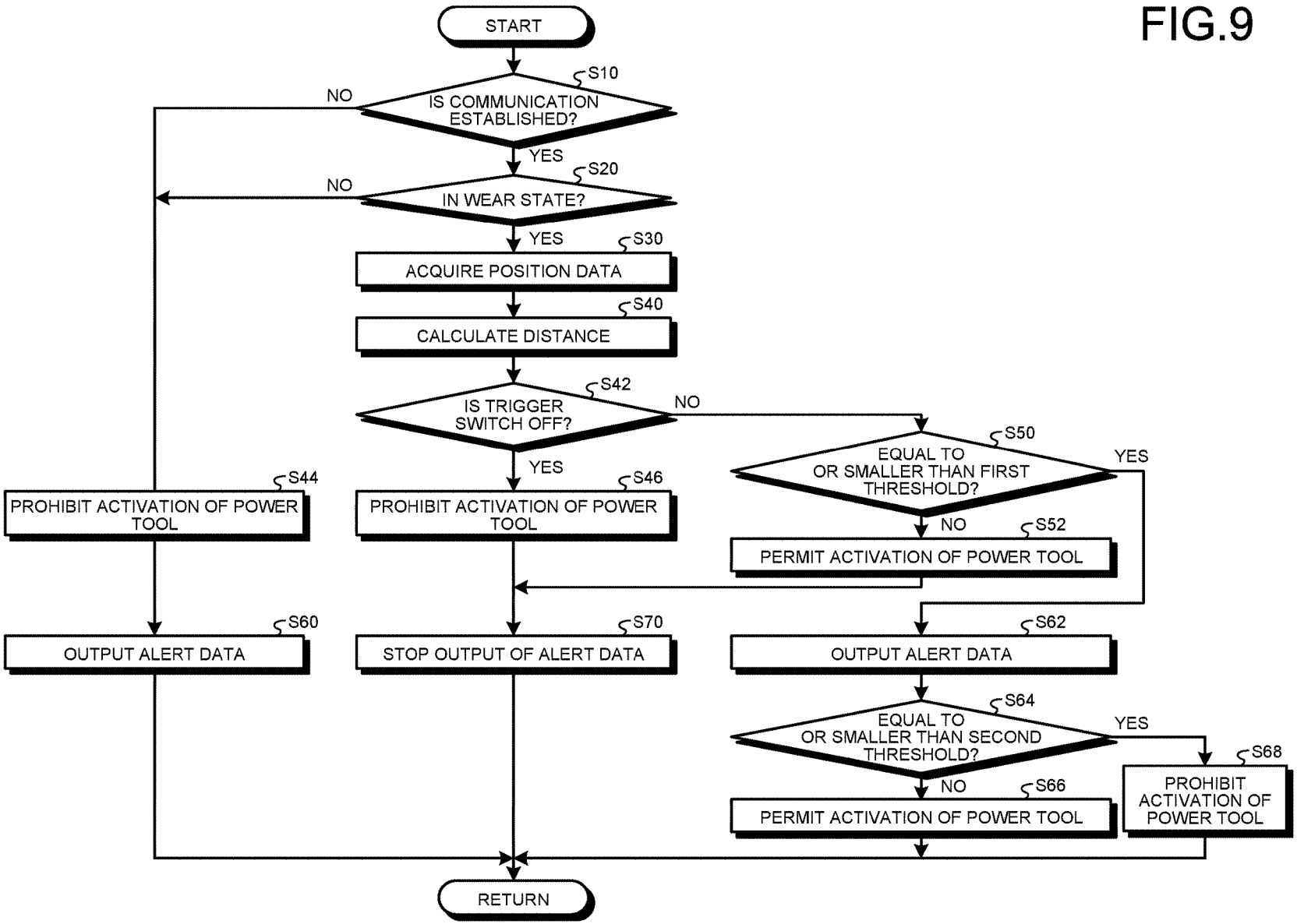
FIG. 9 is a flowchart illustrating an example of the operation of the garment according to the second embodiment.
Figure 10:
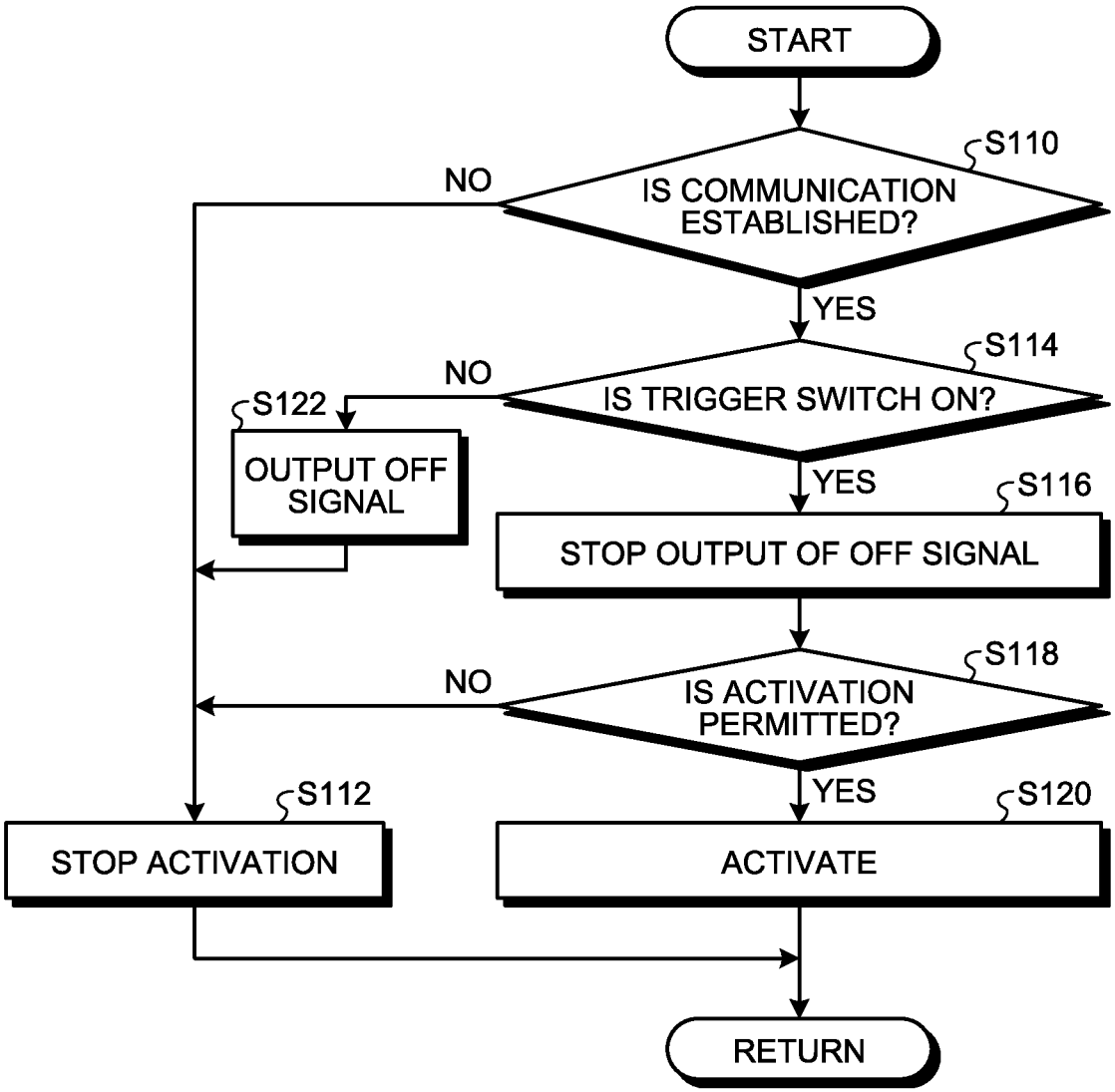
FIG. 10 is a flowchart illustrating an example of the operation of a power tool according to the second embodiment.

An example of the operation of the alert system S2 according to the present embodiment will now be described. FIG. 9 is a flowchart illustrating an example of the operation of the garment 100 according to the present embodiment. FIG. 10 is a flowchart illustrating an example of the operation of the power tool 300 according to the present embodiment.

Referring to FIG. 9, an example of the operation of the garment 100 is described. In the garment 100, the power tool battery 80A is attached to the adapter 70, whereby each of the wear detection device 20, the position detection device 30, the garment communication device 40, the alert device 50, and the control device 60 is started by power supplied from the power tool battery 80A. The wear detection device 20 detects a biometric signal. The position detection device 30 detects first position data. The first communication device 41 of the garment communication device 40 makes a connection request to the external communication equipment 200.

The determination unit 61 determines whether communication between the first communication device 41 and the external communication equipment 200 is established (step S10).

At step S10, when it is determined that the first communication device 41 is unable to communicate with the external communication equipment 200 (No at step S10), the output unit 65 outputs a tool signal for prohibiting the activation of the power tool 300 to the power tool 300 through the garment communication device 40 and the tool communication device 240. The control device 260 prohibits the activation of the power tool 300 (step S44).

At step S10, when it is determined that the first communication device 41 is unable to communicate with the external communication equipment 200 (No at step S10), the output unit 65 outputs an alert signal for activating the alert device 50 to the alert device 50. The alert device 50 outputs alert data including at least one of sound, vibration, smell, and light, based on the acquired alert signal (step S60).

At step S10, when it is determined that communication between the first communication device 41 and the external communication equipment 200 is established (Yes at step S10), the determination unit 61 determines whether the garment body 10 is worn by the worker P1, that is, in the wear state, based on detection data of the wear detection device 20 (step S20).

At step S20, when it is determined that the garment body 10 is not in the wear state (No at step S20), the output unit 65 outputs a tool signal for prohibiting the activation of the power tool 300 (step S44). The output unit 65 also outputs an alert signal for activating the alert device 50 to the alert device 50. The alert device 50 outputs alert data (step S60).

At step S20, when it is determined that the garment body 10 is in the wear state (Yes at step S20), the external communication equipment 200 transmits second position data indicating the position of the external communication equipment 200 detected by the position detection device 130 to the garment communication device 40 of the garment 100. The distance data acquisition unit 63 acquires the first position data detected by the position detection device 30 and the second position data detected by the position detection device 130 (step S30).

The distance data acquisition unit 63 calculates the distance D between the garment 100 and the external communication equipment 200, based on the first position data and the second position data (step S40).

The determination unit 61 determines whether the tool data acquisition unit 64 has acquired tool data indicating that the trigger switch provided on the power tool 300 has been operated. In the present embodiment, the determination unit 61 determines whether the trigger switch provided on the power tool 300 is not operated, that is, in the off state, based on the tool data acquired by the tool data acquisition unit 64 (step S42).

At step S42, when it is determined that the trigger switch is in the off state (Yes at step S42), the output unit 65 outputs a tool signal for prohibiting the activation of the power tool 300 to the power tool 300 through the garment communication device 40 and the tool communication device 240. The control device 260 prohibits the activation of the power tool 300 (step S46).

At step S42, when it is determined that the trigger switch is in the off state (Yes at step S42), the output unit 65 outputs an alert signal for stopping the activation of the alert device 50. With this process, the activation of the alert device 50 is stopped, and output of alert data from the alert device 50 is stopped (step S70).

At step S42, when it is determined that the trigger switch is not in the off state but operated, that is, in the on state (No at step S42), the output unit 65 determines whether the distance D calculated by the distance data acquisition unit 63 is equal to or smaller than the first threshold R1 (step S50).

At step S50, when it is determined that the distance D is not equal to or smaller than the first threshold R1 (No at step S50), the output unit 65 outputs a tool signal for permitting the activation of the power tool 300 to the power tool 300 through the garment communication device 40 and the tool communication device 240. The control device 260 permits the activation of the power tool 300 (step S52). The power tool 300 is then activated.

The output unit 65 also outputs an alert signal for stopping the activation of the alert device 50. With this process, the activation of the alert device 50 is stopped, and output of alert data from the alert device 50 is stopped (step S70).

At step S50, when it is determined that the distance D is equal to or smaller than the first threshold R1 (Yes at step S50), the output unit 65 outputs an alert signal for activating the alert device 50 to the alert device 50. The alert device 50 outputs alert data (step S62).

The output unit 65 determines whether the distance D calculated by the distance data acquisition unit 63 is equal to or smaller than the second threshold R2 (step S64).

At step S64, when it is determined that the distance D is not equal to or smaller than the second threshold R2 (No at step S64), the output unit 65 outputs a tool signal for permitting the activation of the power tool 300 to the power tool 300 through the garment communication device 40 and the tool communication device 240. The control device 260 permits the activation of the power tool 300 (step S66). The power tool 300 is then activated.

When the activation of the power tool 300 is permitted, the control device 260 allows an output device provided on the power tool 300 to output permission data indicating the permission of activation of the power tool 300. When the output device provided on the power tool 300 is a display device, the control device 260 allows the display device to present display data indicating permission of activation of the power tool 300, as the permission data. When the output device provided on the power tool 300 is an alert device, the control device 260 allows the alert device to issue alert data indicating permission of activation of the power tool 300, as the permission data. An example of the alert data is at least one of sound, vibration, smell, and light.

At step S64, when it is determined that the distance D is equal to or smaller than the second threshold R2 (Yes at step S64), the output unit 65 outputs a tool signal for prohibiting the activation of the power tool 300 to the power tool 300 through the garment communication device 40 and the tool communication device 240. The control device 260 prohibits the activation of the power tool 300 (step S68).

When the activation of the power tool 300 is prohibited, the control device 260 allows an output device provided on the power tool 300 to output prohibition data indicating the prohibition of activation of the power tool 300. When the output device provided on the power tool 300 is a display device, the control device 260 allows the display device to present display data indicating prohibition of activation of the power tool 300, as the prohibition data. When the output device provided on the power tool 300 is an alert device, the control device 260 allows the alert device to issue alert data indicating prohibition of activation of the power tool 300, as the prohibition data.

In the external communication equipment 200, a similar process is performed. More specifically, in the external communication equipment 200, the position detection device 130, the external communication device 140, the alert device 150, and the control device 160 are started. The position detection device 130 detects second position data. When the first communication device 41 of the garment communication device 40 and the external communication device 140 are able to communicate with each other, the first communication device 41 of the garment communication device 40 transmits detection data of the wear detection device 20 and first position data detected by the position detection device 30 to the external communication equipment 200. In the external communication equipment 200, the distance data acquisition unit 163 calculates the distance D between the garment 100 and the external communication equipment 200, based on the first position data transmitted from the garment 100 and the second position data detected by the position detection device 130.

When it is determined that the garment 100 is not in the wear state, the output unit 165 of the external communication equipment 200 outputs an alert signal for activating the alert device 150. When the distance D is equal to or smaller than the first threshold R1, the output unit 165 outputs an alert signal for activating the alert device 150. When it is determined that the first communication device 41 and the external communication device 140 are unable to communicate with each other, the output unit 165 outputs an alert signal for activating the alert device 150. The alert device 150 outputs alert data including at least one of sound, vibration, smell, and light, based on the alert signal.

Referring now to FIG. 10, an example of the operation of the power tool 300 is described. FIG. 10 is a flowchart illustrating an example of the operation of the power tool 300 according to the present embodiment. The control device 260 of the power tool 300 determines whether communication between the second communication device 42 of the garment 100 and the tool communication device 240 of the power tool 300 is established (step S110).

At step S110, when it is determined that the second communication device 42 and the tool communication device 240 are unable to communicate with each other (No at step S110), the control device 260 stops the activation of the power tool 300 (step S112).

At step S110, when it is determined that communication between the second communication device 42 and the tool communication device 240 is established (Yes at step S110), the control device 260 determines whether the trigger switch provided on the power tool 300 is in the on state (step S114).

At step S114, when it is determined that the trigger switch is in the on state (Yes at step S114), the control device 260 stops output of an off signal for stopping the activation of the power tool 300 (step S116).

The control device 260 determines whether a tool signal for permitting the activation of the power tool 300 is output from the garment 100 (step S118).

At step S118, the control device 260 acquires a tool signal for permitting the activation of the power tool 300 from the garment 100, and when it is determined that the activation of the power tool 300 is permitted (Yes at step S118), the control device 260 activates the power tool 300 (step S120).

At step S114, when it is determined that the trigger switch is not in the on state (No at step S114), the control device 260 outputs an off signal for stopping the activation of the power tool 300 (step S122). The activation of the power tool 300 is then stopped (step S112).

At step S118, when it is determined that the activation of the power tool 300 is not permitted (No at step S118), the control device 260 stops the activation of the power tool 300 (step S112).

Figure 11:
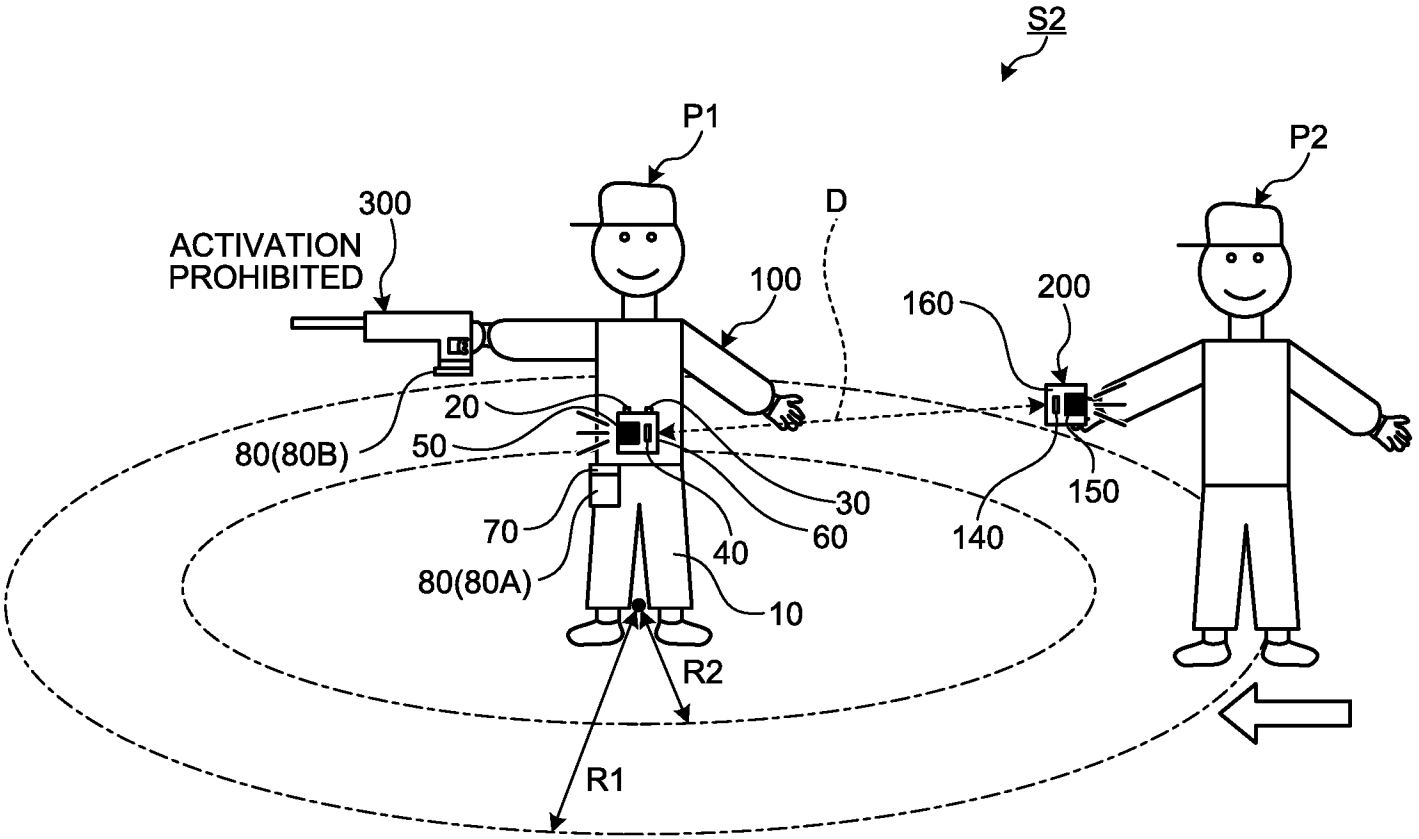
FIG. 11 is a diagram schematically illustrating a state of each of the garment and the external communication equipment when an alert signal and a tool signal are output in the alert system according to the second embodiment.

FIG. 11 is a diagram schematically illustrating a state of each of the garment 100 and the external communication equipment 200 when an alert signal and a tool signal are output in the alert system S2 according to the present embodiment. FIG. 11 illustrates an example in which the alert device 50 and the alert device 150 are activated and the activation of the power tool 300 is prohibited because the distance D is equal to or smaller than the second threshold R2.

As illustrated in FIG. 11, the worker P1 carries out work using the power tool 300 while wearing the garment 100. When the third person P2 carrying the external communication equipment 200 approaches the worker P1 and the distance D between the garment 100 and the external communication equipment 200 is equal to or smaller than the first threshold R1, the alert system S2 activates each of the alert device 50 provided on the garment 100 and the alert device 150 provided on the external communication equipment 200.

When the distance D is equal to or smaller than the second threshold R2 smaller than the first threshold R1, the activation of the power tool 300 is prohibited.

Even if the distance D is greater than the first threshold R1, as described above, the activation of the power tool 300 is prohibited and the alert device 50 is activated when the garment 100 is not worn by the worker P1 or when the first communication device 41 and the external communication equipment 200 are not in communication with each other. Also in the present embodiment, the alert device 50 is activated when any trouble occurs in the alert system S2.

Advantageous Effects

As explained above, according to the present embodiment, when the worker P1 is not wearing the garment 100, the activation of the power tool 300 is prohibited. If the worker P1 not wearing the designated garment 100 carries out work using the power tool 300, the workability may be reduced or an unexpected event may occur. In the present embodiment, when the worker P1 is not wearing the designated garment 100, the activation of the power tool 300 is prohibited, so that reduction in workability and occurrence of an unexpected event can be prevented, and a good work environment can be maintained in worksites.

According to the present embodiment, the activation of the power tool 300 is prohibited also when communication between the first communication device 41 of the garment 100 and the external communication equipment 200 is not established. When communication between the first communication device 41 of the garment 100 and the external communication equipment 200 is not established, data communication between the garment 100 and the external communication equipment 200 fails, so that the third person P2 may be unable to manage the status of the worker P1, the workability may be reduced, or an unexpected event may occur. In the present embodiment, the activation of the power tool 300 is prohibited when communication between the first communication device 41 of the garment 100 and the external communication equipment 200 is not established. This prevents the worker P1 from carrying out work using the power tool 300 in a state in which communication is not established.

According to the present embodiment, the control device 60 outputs a tool signal for controlling the power tool 300 based on the distance data. With this configuration, when the worker P1 and the third person P2 approach each other, the power tool 300 enters the activation-prohibited state to prevent the activated power tool 300 and the third person P2 from approaching each other. This prevents occurrence of an unexpected event. When the worker P1 and the third person P2 are located sufficiently far away from each other, the power tool 300 is in the activation-enabled state. This prevents the power tool 300 from unnecessarily entering the activation-prohibited state. If the power tool 300 is brought into the activation-prohibited state unnecessarily, the workability is reduced. According to the present embodiment, when the distance D between the worker P1 holding the power tool 300 and the third person P2 is short, the activation of the power tool 300 is prohibited, and when the distance D between the worker P1 and the third person P2 is long, the prohibition of activation of the power tool 300 is removed. When the worker P1 and the third person P2 approach each other, the power tool 300 enters the activation-prohibited state as necessary to prevent the activated power tool 300 and the third person P2 from approaching each other, while preventing reduction in workability.

Also in the present embodiment, the alert device 50 and the alert device 150 can be activated when necessary. In a worksite in which a worker P1 and a third person P2 are present, reduction in workability and occurrence of an unexpected event are prevented and therefore a good work environment can be maintained.

In the present embodiment, when the distance D is equal to or smaller than the first threshold R1 and is greater than the second threshold R2, the alert device 50 is activated and the power tool 300 is in the activation-enabled state. When the distance D is equal to or smaller than the second threshold R2, the activation of the power tool 300 is prohibited. With this configuration, activation and activation stop of the alert device 50 and the alert device 150 can be controlled based on the first threshold R1. The activation-enabled state and the activation-prohibited state of the power tool 300 can be controlled based on the second threshold R2.

Third Embodiment

A third embodiment will be described. In the following description, the same components as those in the foregoing embodiments are denoted by the same reference signs and a description thereof is simplified or omitted.

Figure 12:
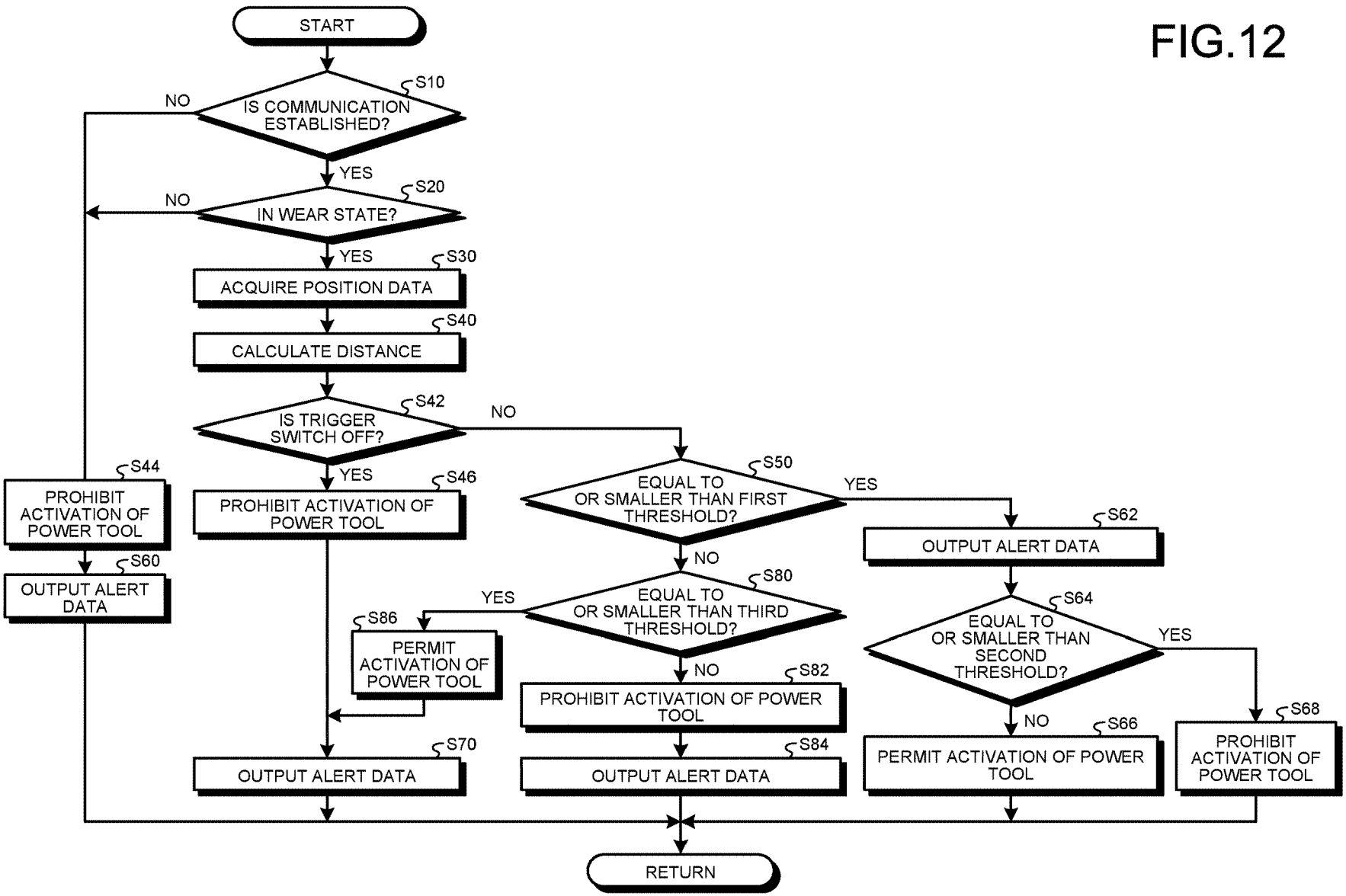
FIG. 12 is a flowchart illustrating an example of the operation of the garment according to a third embodiment.

FIG. 12 is a flowchart illustrating an example of the operation of the garment 100 according to the present embodiment. In the present embodiment, a first threshold R1, a second threshold R2 smaller than the first threshold R1, and a third threshold R3 greater than the first threshold R1 are defined for the distance D and stored in the threshold storage unit 66.

In the flowchart illustrated in FIG. 12, the processes at steps S10, S20, S30, S40, S42, S44, S46, S50, S60, S62, S64, S66, S68, and S70 are similar to the processes described with reference to FIG. 9 and a description thereof is omitted.

At step S50, when it is determined that the distance D is not equal to or smaller than the first threshold R1 (No at step S50), the output unit 65 determines whether the distance D calculated by the distance data acquisition unit 63 is equal to or smaller than the third threshold R3 (step S80).

At step S80, when it is determined that the distance D is not equal to or smaller than the third threshold R3 (No at step S80), the output unit 65 outputs a tool signal for prohibiting the activation of the power tool 300 to the power tool 300 through the garment communication device 40 and the tool communication device 240. The control device 260 prohibits the activation of the power tool 300 (step S82). The output unit 65 also outputs an alert signal for activating the alert device 50. The alert device 50 outputs alert data (step S84).

At step S80, when it is determined that the distance D is equal to or smaller than the third threshold R3 (Yes at step S80), the output unit 65 outputs a tool signal for permitting the activation of the power tool 300 to the power tool 300 through the garment communication device 40 and the tool communication device 240. The control device 260 permits the activation of the power tool 300 (step S86). The power tool 300 is then activated. The output unit 65 also outputs an alert signal for stopping the activation of the alert device 50. The alert device 50 outputs alert data (step S70).

In the external communication equipment 200, a similar process is performed. More specifically, in the external communication equipment 200, the position detection device 130, the external communication device 140, the alert device 150, and the control device 160 are started. The position detection device 130 detects second position data. When the first communication device 41 of the garment communication device 40 and the external communication device 140 are able to communicate with each other, the first communication device 41 of the garment communication device 40 transmits detection data of the wear detection device 20 and first position data detected by the position detection device 30 to the external communication equipment 200. In the external communication equipment 200, the distance data acquisition unit 163 calculates the distance D between the garment 100 and the external communication equipment 200, based on the first position data transmitted from the garment 100 and the second position data detected by the position detection device 130.

When it is determined that the garment 100 is not in the wear state, the output unit 165 of the external communication equipment 200 outputs an alert signal for activating the alert device 150. When the distance D is equal to or smaller than the first threshold R1, the output unit 165 outputs an alert signal for activating the alert device 150. When the distance D is greater than the third threshold R3, the output unit 165 outputs an alert signal for activating the alert device 150. When it is determined that the first communication device 41 and the external communication device 140 are unable to communicate with each other, the output unit 165 outputs an alert signal for activating the alert device 150.

As explained above, according to the present embodiment, as described with reference to steps S50, S80, S86, and S70, when the distance D is equal to or smaller than the third threshold R3 and is greater than the first threshold R1, the control device 60 permits the activation of the power tool 300 without activating the alert device 50. On the other hand, as described with reference to steps S80, S82, and S84, when the distance D is greater than the third threshold R3, the control device 60 activates the alert device 50 and prohibits the activation of the power tool 300. More specifically, in the present embodiment, when the worker P1 is too far away from the third person P2 (for example, supervisor), the alert device 50 is activated and the activation of the power tool 300 is prohibited. When the worker P1 and the third person P2 are too far away from each other, and the worker P1 carries out work using the power tool 300 out of the sight of the third person P2, the third person P2 may be unable to manage the situation of the worker P1, the workability may be reduced, or an unexpected event may occur. In the present embodiment, therefore, the alert device 50 and the alert device 150 are activated when the worker P1 goes out of the management area. The alert device 50 is activated, whereby the worker P1 can recognize that he/she goes out of the management area. The alert device 150 is activated, whereby the third person P2 can recognize that the worker P1 goes out of the management area. When the worker P1 goes out of the management area, the activation of the power tool 300 carried by the worker P1 is prohibited. This process can prevent reduction in workability and occurrence of an unexpected event and can maintain a good work environment in worksites.

In the present embodiment, when it is determined that the distance D is greater than the third threshold R3 at step S80, both prohibition of activation of the power tool 300 and activation of the alert device 50 are performed. The third threshold R3 used to determine whether to perform prohibition of activation of the power tool 300 and the third threshold R3 used to determine whether to perform activation of the alert device 50 may be different values. For example, in a case where a third threshold 3Ra and a third threshold 3Rb greater than the third threshold 3Ra are defined, when it is determined that the distance D is greater than the third threshold 3Ra, the activation of the alert device 50 may be performed without prohibiting the activation of the power tool 300, and when it is determined that the distance D is greater than the third threshold 3Rb, the prohibition of activation of the power tool 300 may be performed while the activation of the alert device 50 is performed.

Fourth Embodiment

A fourth embodiment will be described. In the following description, the same components as those in the foregoing embodiments are denoted by the same reference signs and a description thereof is simplified or omitted. In the present embodiment, a modification of the processing in the alert system S1 described in the foregoing first embodiment will be described.

In the present embodiment, the garment communication device 40 communicates with the external communication equipment 200 when the garment body 10 is worn by the worker P1. The garment communication device 40 communicates with the external communication equipment 200 based on detection data of the wear detection device 20. When the wear detection device 20 detects that the garment body 10 is in the wear state, the garment communication device 40 starts communication with the external communication equipment 200. When the wear detection device 20 detects that the garment body 10 is in the non-wear state, the garment communication device 40 terminates communication with the external communication equipment 200.

The control device 60 controls the garment communication device 40 and the alert device 50, based on detection data of the wear detection device 20 and detection data of the position detection device 30. In the present embodiment, the control device 60 outputs an alert signal for controlling the alert device 50 based on distance data indicating the distance D from the external communication equipment 200 acquired through the communication with the external communication equipment 200.

When the determination unit 61 determines that the garment body 10 is worn by the worker P1, that is, in the wear state, the communication control unit 62 controls the garment communication device 40 to start communication with the external communication equipment 200. When the determination unit 61 determines that the garment body 10 is not worn by the worker P1, that is, in the non-wear state, the communication control unit 62 controls the garment communication device 40 to terminate communication with the external communication equipment 200.

Figure 13:
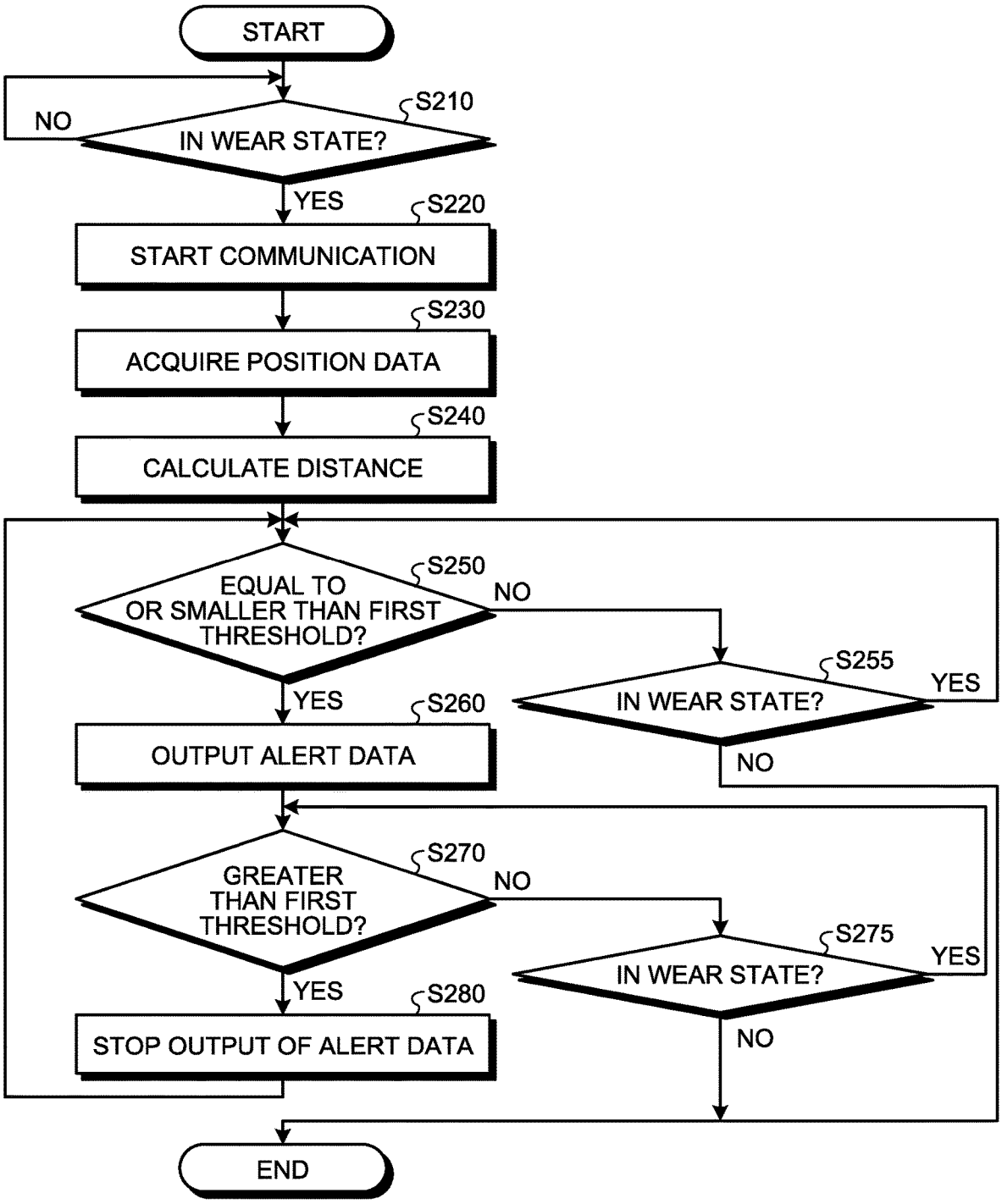
FIG. 13 is a flowchart illustrating an example of the operation of the garment according to a fourth embodiment.

FIG. 13 is a flowchart illustrating an example of the operation of the garment 100 according to the present embodiment. In the garment 100, the power tool battery 80A is attached to the adapter 70, whereby each of the wear detection device 20, the position detection device 30, the garment communication device 40, the alert device 50, and the control device 60 is started by power supplied from the power tool battery 80A. The wear detection device 20 detects a biometric signal. The position detection device 30 detects first position data.

The determination unit 61 determines whether the garment body 10 is worn by the worker P1, that is, in the wear state, based on detection data of the wear detection device 20 (step S210).

At step S210, when it is determined that the garment body 10 is not in the wear state (No at step S210), the process at step S210 is performed again. At step S210, when it is determined that the garment body 10 is in the wear state (Yes at step S210), the communication control unit 62 allows the garment communication device 40 to start communication with the external communication equipment 200 (step S220).

When communication between the garment communication device 40 and the external communication equipment 200 is started, the external communication equipment 200 transmits second position data indicating the position of the external communication equipment 200 detected by the position detection device 130 to the garment communication device 40 of the garment 100. The distance data acquisition unit 63 acquires the first position data detected by the position detection device 30 and the second position data detected by the position detection device 130 (step S230).

The distance data acquisition unit 63 calculates the distance D between the garment 100 and the external communication equipment 200, based on the first position data and the second position data (step S240).

The output unit 65 determines whether the distance D calculated by the distance data acquisition unit 63 is equal to or smaller than the first threshold R1 (step S250).

At step S250, when it is determined that the distance D is not equal to or smaller than the first threshold R1 (No at step S250), the determination unit 61 determines whether the garment body 10 is in the wear state, based on detection data of the wear detection device 20 (step S255). During the process, the worker P1 may take off the garment 100. Then, at step S255, it is determined whether the garment 100 is in the wear state.

At step S255, when it is determined that the garment body 10 is in the wear state (Yes at step S255), the process at step S250 is performed again. At step S255, when it is determined that the garment body 10 is in the non-wear state (No at step S255), the process ends.

At step S250, when it is determined that the distance D is equal to or smaller than the first threshold R1 (Yes at step S250), the output unit 65 outputs an alert signal for activating the alert device 50 to the alert device 50. The alert device 50 outputs alert data including at least one of sound, vibration, smell, and light, based on the acquired alert signal (step S260).

After the alert data is output, the output unit 65 determines whether the distance D is greater than the first threshold R1 (step S270). Because of the alert data being output, it is likely that the third person P2 moves away from the worker P1. Then, at step S270, it is determined whether the distance D is greater than the first threshold R1.

At step S270, when it is determined that the distance D is equal to or smaller than the first threshold R1 (No at step S270), the determination unit 61 determines whether the garment body 10 is in the wear state (step S275).

At step S275, when it is determined that the garment body 10 is not in the wear state (No at step S275), the process ends. At step S275, when it is determined that the garment body 10 is in the wear state (Yes at step S275), the process at step S270 is performed again. In the period during which the process at step S270 is repeatedly performed, the alert device 50 continues outputting alert data.

At step S270, when it is determined that the distance D is greater than the first threshold R1 (Yes at step S270), the output unit 65 outputs an alert signal for stopping the activation of the alert device 50. With this process, the operation of the alert device 50 is stopped, and output of alert data from the alert device 50 is stopped (step S280). Thereafter, the processes subsequent to step S250 are repeatedly performed.

In the external communication equipment 200, a similar process is performed. More specifically, in the external communication equipment 200, the position detection device 130, the external communication device 140, the alert device 150, and the control device 160 are started. The position detection device 130 detects second position data. When communication between the garment communication device 40 and the external communication device 140 is started, the garment communication device 40 of the garment 100 transmits the first position data detected by the position detection device 30 to the external communication equipment 200. In the external communication equipment 200, the distance data acquisition unit 163 calculates the distance D between the garment 100 and the external communication equipment 200, based on the first position data transmitted from the garment 100 and the second position data detected by the position detection device 130.

When the distance D is equal to or smaller than the first threshold R1, the output unit 165 of the external communication equipment 200 outputs an alert signal for activating the alert device 150. The alert device 150 outputs alert data including at least one of sound, vibration, smell, and light, based on the alert signal. The alert device 150 continuous outputting alert data until it is determined that the distance D is greater than the first threshold R1.

As explained above, according to the present embodiment, when the garment body 10 is worn by the worker P1, the garment communication device 40 starts communication with the external communication equipment 200. With this process, even when the third person P2 approaches the garment 100 not worn by the worker P1, alert data is not output from the alert device 50 and the alert device 150. If the garment communication device 40 and the external communication equipment 200 start communication even when the garment body 10 is not worn by the worker P1, for example, mere approach of the third person P2 to the storage space in which the garment 100 is stored activates the alert device 50 and the alert device 150. As a result, the third person P2 carrying the external communication equipment 200 feels discomfort. According to the present embodiment, when the garment body 10 is worn by the worker P1, the garment communication device 40 and the external communication equipment 200 communicate with each other, and when the distance D is reduced, alert data is output from the alert device 50 and the alert device 150.

In this way, also in the present embodiment, the alert device 50 and the alert device 150 are activated when necessary, and the alert device 50 and the alert device 150 are not activated when unnecessary. In a worksite in which a worker P1 and a third person P2 are present, therefore, a good work environment can be maintained.

In the foregoing embodiments, when it is determined that the garment body 10 is in the wear state, the communication control unit 62 allows the garment communication device 40 to start communication with the external communication equipment 200. The communication control unit 62 may allow the garment communication device 40 to start communication with the external communication equipment 200 when it is determined that the power tool battery 80A is attached to the adapter 70. When the power tool battery 80A is attached to the adapter 70, the adapter 70 can output a detection signal indicating that the power tool battery 80A has been attached to the control device 60. The determination unit 61 therefore can determine whether the power tool battery 80A has been attached to the adapter 70, based on a detection signal from the adapter 70.

In the foregoing embodiment, the process ends when it is determined that the garment body 10 is not in the wear state at step S255 or step S275. The process may end when it is determined that the power tool battery 80A has been detached from the adapter 70.

Fifth Embodiment

A fifth embodiment will be described. In the following description, the same components as those in the foregoing embodiments are denoted by the same reference signs and a description thereof is simplified or omitted. In the present embodiment, a modification of the processing in the alert system S2 described in the foregoing second embodiment will be described.

As described with reference to FIG. 8, the arithmetic processing unit 60A of the control device 60 has the tool data acquisition unit 64 acquiring tool data indicating a state of the power tool 300. In the present embodiment, the tool data includes tool data indicating an activated state in which the power tool 300 is being activated and tool data indicating a non-activated state in which the power tool 300 is not being activated. When the power tool 300 is being activated, the control device 260 of the power tool 300 transmits tool data indicating the activated state in which the power tool 300 is being activated to the garment 100 through the tool communication device 240. When the power tool 300 is not being activated, the control device 260 of the power tool 300 transmits tool data indicating the non-activated state in which the power tool 300 is not being activated to the garment 100 through the tool communication device 240. The tool data acquisition unit 64 can acquire tool data from the power tool 300 through communication between the garment communication device 40 and the tool communication device 240.

The control device 260 controls the activation state of the power tool 300. In the present embodiment, the control device 60 of the garment 100 outputs a tool signal, which is a command signal for controlling the power tool 300, based on distance data indicating the distance D between the garment 100 and the external communication equipment 200. The tool signal output from the control device 60 is transmitted to the tool communication device 240 through the garment communication device 40. The control device 260 of the power tool 300 controls the power tool 300 based on the tool signal output from the control device 60.

As in the foregoing embodiments, when the distance D is greater than the first threshold R1, the control device 60 does not activate the alert device 50. When the distance D is greater than the first threshold R1, the power tool 300 is in the activation-enabled state.

As in the foregoing embodiments, the wording "when the power tool 300 is activated" refers to when the main power supply of the power tool 300 is turned on or when the trigger switch provided on the power tool 300 is operated. In the activation-enabled state of the power tool 300, the power tool 300 is activated when the main power supply of the power tool 300 is turned on or when the trigger switch provided on the power tool 300 is operated by the worker P1.

When the distance D is equal to or smaller than the first threshold R1 and is greater than the second threshold R2, the control device 60 outputs an alert signal for activating the alert device 50. When the distance D is equal to or smaller than the first threshold R1 and is greater than the second threshold R2, the power tool 300 is in the activation-enabled state. The second threshold R2 is a predetermined value for the distance D and stored in the threshold storage unit 66 of the storage device 60B. The second threshold R2 is smaller than the first threshold R1.

When the distance D is equal to or smaller than the second threshold R2, the control device 60 outputs a tool signal for prohibiting the activation of the power tool 300. The control device 260 of the power tool 300 brings the power tool 300 into the activation-prohibited state, based on the tool signal for prohibiting the activation of the power tool 300. In the activation-prohibited state of the power tool 300, the power tool 300 is not activated even when the worker P1 operates the trigger switch provided on the power tool 300.

In the present embodiment, the output unit 65 of the control device 60 outputs an alert signal for controlling the alert device 50, based on the tool data indicating a state of the power tool 300 acquired through communication with the tool communication device 240.

In the present embodiment, the control device 60 activates the alert device 50 when the power tool 300 is being activated. On the other hand, the control device 60 does not activate the alert device 50 when the power tool 300 is not being activated. When the power tool 300 is being activated, the control device 60 activates the alert device 50 based on distance data indicating the distance D between the garment 100 and the external communication equipment 200. More specifically, in a state in which the power tool 300 is being activated, when the distance D is equal to or smaller than the first threshold R1, the alert device 50 is activated, and when the distance D is greater than the first threshold R1, the alert device 50 is not activated.

The garment communication device 40 communicates with the external communication equipment 200 when the power tool 300 held by the worker P1 is activated. When tool data indicating the activated state in which the power tool 300 is being activated is acquired from the tool communication device 240, the communication control unit 62 controls the garment communication device 40 to start communication with the external communication equipment 200. When tool data indicating the non-activated state in which the power tool 300 is not being activated is acquired from the tool communication device 240, the communication control unit 62 controls the garment communication device 40 to terminate communication with the external communication equipment 200.

Figure 14:
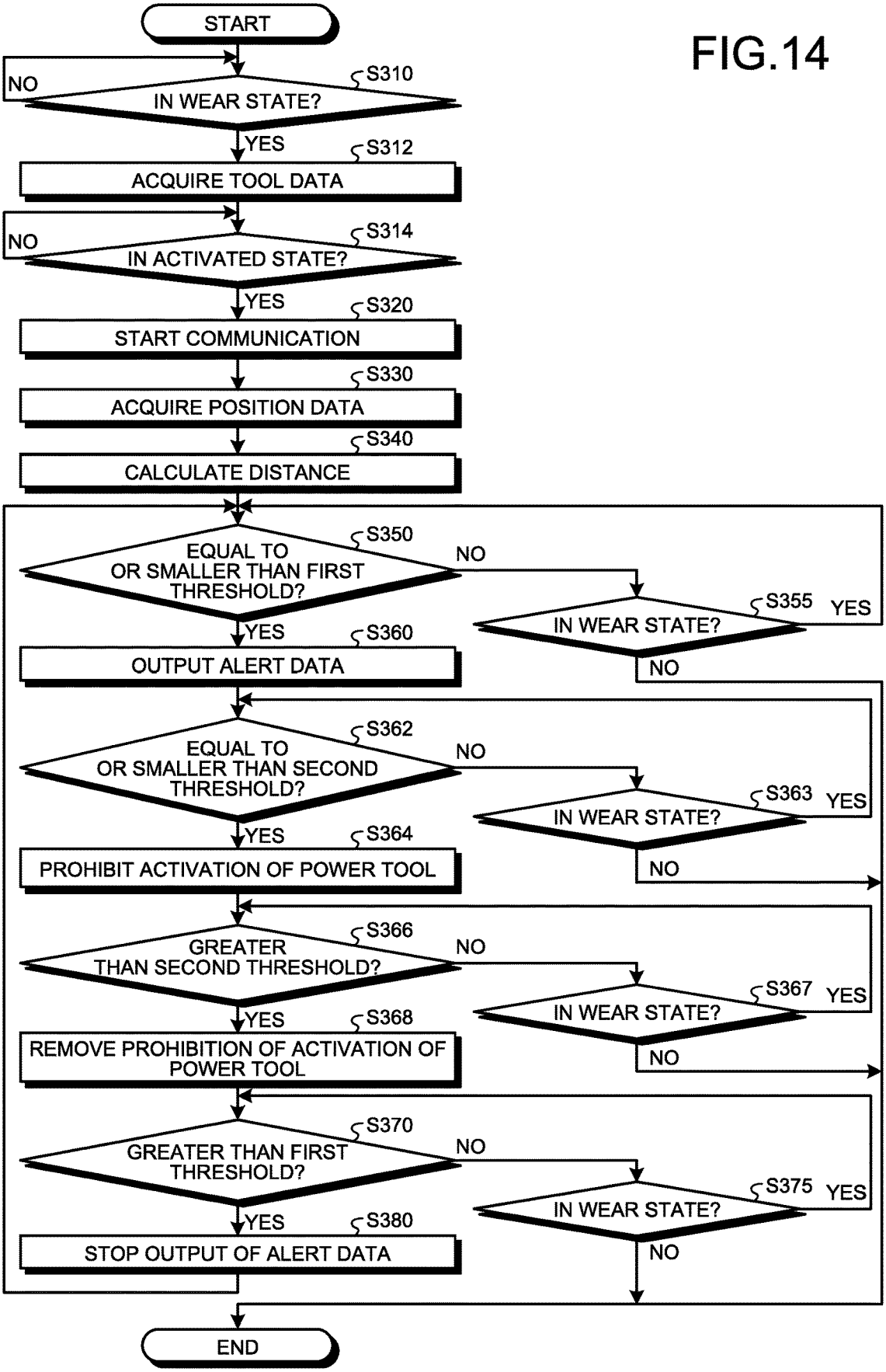
FIG. 14 is a flowchart illustrating an example of the operation of the garment according to a fifth embodiment.

FIG. 14 is a flowchart illustrating an example of the operation of the garment 100 according to the present embodiment. In the garment 100, the power tool battery 80A is attached to the adapter 70, whereby each of the wear detection device 20, the position detection device 30, the garment communication device 40, the alert device 50, and the control device 60 is started by power supplied from the power tool battery 80A. The wear detection device 20 detects a biometric signal. The position detection device 30 detects first position data. The tool communication device 240 of the power tool 300 transmits tool data indicating a state of the power tool 300 to the garment 100.

The determination unit 61 determines whether the garment body 10 is worn by the worker P1, that is, in the wear state, based on detection data of the wear detection device 20 (step S310).

At step S310, when it is determined that the garment body 10 is not in the wear state (No at step S310), the process at step S310 is performed again. At step S310, when it is determined that the garment body 10 is in the wear state (Yes at step S310), the tool data acquisition unit 64 acquires the tool data transmitted from the power tool 300 (step S312).

The output unit 65 determines whether the power tool 300 is in the activated state, based on the tool data acquired by the tool data acquisition unit 64 (step S314).

At step S314, when it is determined that the power tool 300 is not in the activated state (No at step S314), the process at step S314 is performed again. At step S314, when it is determined that the power tool 300 is in the activated state (Yes at step S314), the communication control unit 62 allows the garment communication device 40 to start communication with the external communication equipment 200 (step S320).

When communication between the garment communication device 40 and the external communication device 140 is started, the distance data acquisition unit 63 acquires the first position data detected by the position detection device 30 and the second position data detected by the position detection device 130 (step S330).

The distance data acquisition unit 63 calculates the distance D between the garment 100 and the external communication equipment 200, based on the acquired first position data and second position data (step S340).

The output unit 65 determines whether the distance D calculated by the distance data acquisition unit 63 is equal to or smaller than the first threshold R1 (step S350).

At step S350, when it is determined that the distance D is not equal to or smaller than the first threshold R1 (No at step S350), the determination unit 61 determines whether the garment body 10 is in the wear state, based on detection data of the wear detection device 20 (step S355).

At step S355, when it is determined that the garment body 10 is in the wear state (Yes at step S355), the process at step S350 is performed again. At step S355, when it is determined that the garment body 10 is in the non-wear state (No at step S355), the process ends.

At step S350, when it is determined that the distance D is equal to or smaller than the first threshold R1 (Yes at step S350), the output unit 65 outputs an alert signal for activating the alert device 50 to the alert device 50. The alert device 50 outputs alert data including at least one of sound, vibration, smell, and light, based on the acquired alert signal (step S360).

The output unit 65 determines whether the distance D calculated by the distance data acquisition unit 63 is equal to or smaller than the second threshold R2 (step S362).

At step S362, when it is determined that the distance D is not equal to or smaller than the second threshold R2 (No at step S362), the determination unit 61 determines whether the garment body 10 is in the wear state, based on detection data of the wear detection device 20 (step S363).

At step S363, when it is determined that the garment body 10 is in the wear state (Yes at step S363), the process at step S62 is performed again. At step S363, when it is determined that the garment body 10 is in the non-wear state (No at step S363), the process ends.

At step S362, when it is determined that the distance D is equal to or smaller than the second threshold R2 (Yes at step S362), the output unit 65 outputs a tool signal for prohibiting the activation of the power tool 300 to the power tool 300 through the garment communication device 40 and the tool communication device 240. The control device 260 prohibits the activation of the power tool 300 (step S364).

After the activation of the power tool 300 is prohibited, the output unit 65 determines whether the distance D is greater than the second threshold R2 (step S366). Because of the alert data being output, it is likely that the third person P2 moves away from the worker P1. Then, at step S366, it is determined whether the distance D is greater than the second threshold R2.

At step S366, when it is determined that the distance D is equal to or smaller than the second threshold R2 (No at step S366), the determination unit 61 determines whether the garment body 10 is in the wear state (step S367).

At step S367, when it is determined that the garment body 10 is not in the wear state (No at step S367), the process ends. At step S367, when it is determined that the garment body 10 is in the wear state (Yes at step S367), the process at step S366 is performed again. In the period during which the process at step S366 is repeatedly performed, the activation of the power tool 300 continues being prohibited.

At step S366, when it is determined that the distance D is greater than the second threshold R2 (Yes at step S366), the output unit 65 outputs a tool signal for removing the prohibition of activation of the power tool 300. The power tool 300 then enters the activation-enabled state (step S368).

After the prohibition of activation of the power tool 300 is removed, the output unit 65 determines whether the distance D is greater than the first threshold R1 (step S370).

At step S370, when it is determined that the distance D is equal to or smaller than the first threshold R1 (No at step S370), the determination unit 61 determines whether the garment body 10 is in the wear state (step S375).

At step S375, when it is determined that the garment body 10 is not in the wear state (No at step S375), the process ends. At step S375, when it is determined that the garment body 10 is in the wear state (Yes at step S375), the process at step S370 is performed again. In the period during which the process at step S370 is repeatedly performed, the alert device 50 continues outputting alert data.

At step S370, when it is determined that the distance D is greater than the first threshold R1 (Yes at step S370), the output unit 65 outputs an alert signal for stopping the activation of the alert device 50. With this process, the activation of the alert device 50 is stopped, and output of alert data from the alert device 50 is stopped (step S380). Thereafter, the processes subsequent to step S350 are repeatedly performed.

In the present embodiment, when the garment body 10 is worn by the worker P1 and the activation of the power tool 300 is started, the garment communication device 40 starts communication with the external communication equipment 200. In the present embodiment, the process at step S310 may be omitted. More specifically, the garment communication device 40 may start communication with the external communication equipment 200 when the activation of the power tool 300 is started, without determining whether the garment body 10 is worn by the worker P1.

As explained above, according to the present embodiment, the control device 60 outputs a tool signal for controlling the power tool 300 based on distance data. With this configuration, when the worker P1 and the third person P2 approach each other, the power tool 300 enters the activation-prohibited state to prevent the activated power tool 300 and the third person P2 from approaching each other. This prevents occurrence of an unexpected event. When the worker P1 and the third person P2 are located sufficiently far away from each other, the power tool 300 is in the activation-enabled state. This prevents the power tool 300 from unnecessarily entering the activation-prohibited state. If the power tool 300 is brought into the activation-prohibited state unnecessarily, the workability is reduced. According to the present embodiment, when the distance D between the worker P1 holding the power tool 300 and the third person P2 is short, the activation of the power tool 300 is prohibited, and when the distance D between the worker P1 and the third person P2 is long, the prohibition of activation of the power tool 300 is removed. When the worker P1 and the third person P2 approach each other, the power tool 300 enters the activation-prohibited state as necessary to prevent the activated power tool 300 and the third person P2 from approaching each other, while preventing reduction in workability.

According to the present embodiment, when the power tool 300 held by the worker P1 is activated, the garment communication device 40 starts communication with the external communication equipment 200. With this process, even when the third person P2 approaches the power tool 300 not activated, alert data is not output from the alert device 50 or the alert device 150. If the garment communication device 40 and the external communication equipment 200 start communication even when the power tool 300 is not being activated, mere approach of the third person P2 to the power tool 300 not activated activates the alert device 50 and the alert device 150. As a result, the third person P2 carrying the external communication equipment 200 feels discomfort. According to the present embodiment, when the power tool 300 is being activated, the garment communication device 40 and the external communication equipment 200 communicate with each other, and when the distance D is reduced, alert data is output from the alert device 50 and the alert device 150.

According to the present embodiment, the alert device 50 is controlled based on tool data indicating a state of the power tool 300. The control device 60 activates the alert device 50 based on distance data when the power tool 300 is being activated, and does not activate the alert device 50 when the power tool 300 is not being activated. For example, in a case where the alert device 50 is controlled only considering the distance D without considering a state of the power tool 300, the alert device 50 is unnecessarily activated even when the worker P1 holding the power tool 300 not activated and the third person P2 approach each other. In the present embodiment, when the worker P1 holding the power tool 300 not activated and the third person P2 approach each other, the alert device 50 is not activated. On the other hand, when the worker P1 holding the power tool 300 activated and the third person P2 approach each other, the alert device 50 is activated. This configuration allows recognition that the power tool 300 activated and the third person P2 approach each other.

As described above, also in the present embodiment, the alert device 50 and the alert device 150 can be activated when necessary. With this configuration, in a worksite in which a worker P1 and a third person P2 are present, reduction in workability and occurrence of an unexpected event are prevented and therefore a good work environment can be maintained.

In the present embodiment, when the distance D is equal to or smaller than the first threshold R1 and is greater than the second threshold R2, the alert device 50 is activated and the power tool 300 is in the activation-enabled state. When the distance D is equal to or smaller than the second threshold R2, the activation of the power tool 300 is prohibited. With this configuration, activation and activation stop of the alert device 50 and the alert device 150 can be controlled based on the first threshold R1. In addition, the activation-enabled state and the activation-prohibited state of the power tool 300 can be controlled based on the second threshold R2.

In the present embodiment, the control device 260 of the power tool 300 can transmit tool data indicating that the power tool 300 is held by the worker P1 from the tool communication device 240 to the garment 100. The control device 260 can determine whether the power tool 300 is held by the worker P1, for example, based on detection data of a pressure sensor provided on the handle of the power tool 300. The communication control unit 62 of the garment 100 can determine whether the power tool 300 held by the worker P1 is activated, based on tool data indicating that the power tool 300 is held by the worker P1 and tool data indicating the activated state in which the power tool 300 is being activated. When it is determined that the power tool 300 held by the worker P1 is being activated, the communication control unit 62 can start communication between the garment communication device 40 and the external communication equipment 200.

Sixth Embodiment

A sixth embodiment will be described. In the following description, the same components as those in the foregoing embodiments are denoted by the same reference signs and a description thereof is simplified or omitted.

Figure 15:
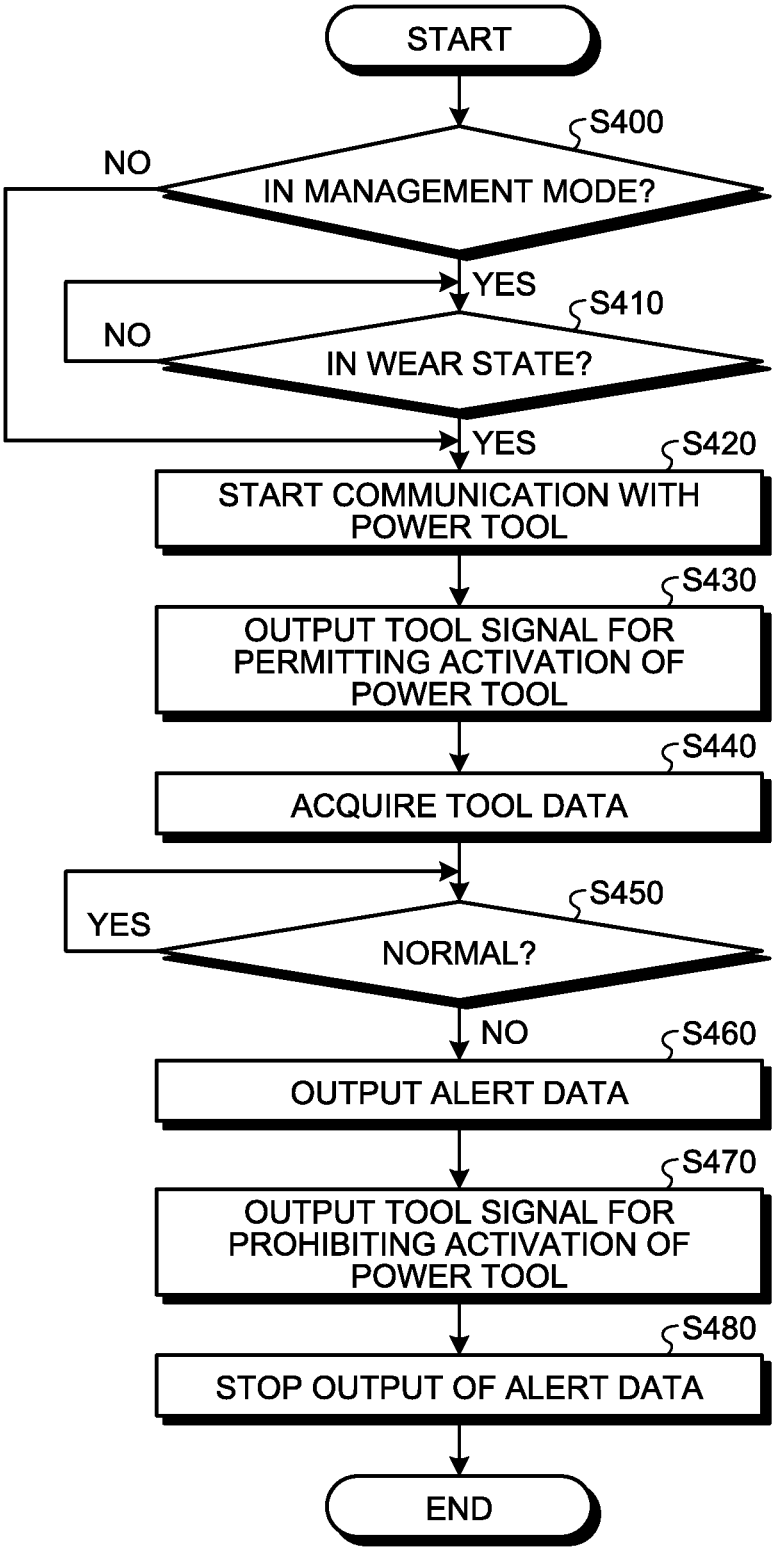
FIG. 15 is a flowchart illustrating an example of the operation of the garment according to a sixth embodiment.

FIG. 15 is a flowchart illustrating an example of the operation of the garment 100 according to the present embodiment. In the garment 100, the power tool battery 80A is attached to the adapter 70, whereby each of the wear detection device 20, the position detection device 30, the garment communication device 40, the alert device 50, and the control device 60 is started by power supplied from the power tool battery 80A. The wear detection device 20 detects a biometric signal.

In the present embodiment, the power tool 300 is in the activation-enabled state when the garment body 10 is worn by the worker P1. In the present embodiment, the garment 100 is provided with an operating device for selecting a management mode in which the power tool 300 is brought into the activation-prohibited state when the garment body 10 is not worn by the worker P1 and a normal mode in which the power tool 300 is not brought into the activation-prohibited state even when the garment body 10 is not worn by the worker P1. An operation signal generated by the operating device being operated is output to the control device 60.

The determination unit 61 determines whether the management mode has been selected, based on the operation signal from the operating device (step S400).

At step S400, when it is determined that the management mode has been selected (Yes at step S400), the determination unit 61 determines whether the garment body 10 is worn by the worker P1, that is, in the wear state, based on detection data of the wear detection device 20 (step S410).

At step S410, when it is determined that the garment body 10 is not in the wear state (No at step S410), the process at step S410 is performed again.

At step S410, when it is determined that the garment body 10 is in the wear state (Yes at step S410), the communication control unit 62 allows the garment communication device 40 to start communication with the tool communication device 240 provided on the power tool 300 (step S420).

At step S400, when it is determined that the normal mode has been selected (No at step S400), the process at step S420 is started.

After the start of communication between the garment communication device 40 and the tool communication device 240, the output unit 65 outputs a tool signal for permitting the activation of the power tool 300 to the power tool 300 through the garment communication device 40 and the tool communication device 240 (step S430). The power tool 300 then enters the activation-enabled state. The trigger switch is operated by the worker P1 in the activation-enabled state of the power tool 300, whereby the power tool 300 is activated.

The tool data acquisition unit 64 acquires the tool data transmitted from the power tool 300 (step S440).

The output unit 65 determines whether the power tool 300 is being activated normally, based on the tool data acquired by the tool data acquisition unit 64 (step S450).

At step S450, when it is determined that the power tool 300 is being activated normally (Yes at step S450), the process at step S450 is performed again. At step S450, when it is determined that the power tool 300 is not being activated normally (No at step S450), the output unit 65 outputs an alert signal for activating the alert device 50 to the alert device 50. The alert device 50 outputs alert data including at least one of sound, vibration, smell, and light, based on the acquired alert signal (step S460).

When it is determined that the power tool 300 is not being activated normally, the output unit 65 outputs a tool signal for prohibiting the activation of the power tool 300 to the power tool 300 through the garment communication device 40 and the tool communication device 240 (step S470). The power tool 300 then enters the activation-prohibited state. In the activation-prohibited state of the power tool 300, even when the trigger switch is operated by the worker P1, the power tool 300 is not activated.

After the power tool 300 enters the activation-prohibited state, the output unit 65 outputs an alert signal for stopping the activation of the alert device 50. With this process, the activation of the alert device 50 is stopped, and output of alert data from the alert device 50 is stopped (step S480).

As explained above, according to the present embodiment, the power tool 300 enters the activation-enabled state only when a tool signal for permitting the activation of the power tool 300 is output. In the present embodiment, in a case where the management mode is selected, the power tool 300 enters the activation-prohibited state only when the worker P1 does not wear the garment 100. With this configuration, in a worksite in which a worker P1 and a third person P2 are present, reduction in workability and occurrence of an unexpected event are prevented and therefore a good work environment can be maintained.

Seventh Embodiment

A seventh embodiment will be described. In the following description, the same components as those in the foregoing embodiments are denoted by the same reference signs and a description thereof is simplified or omitted.

Figure 16:
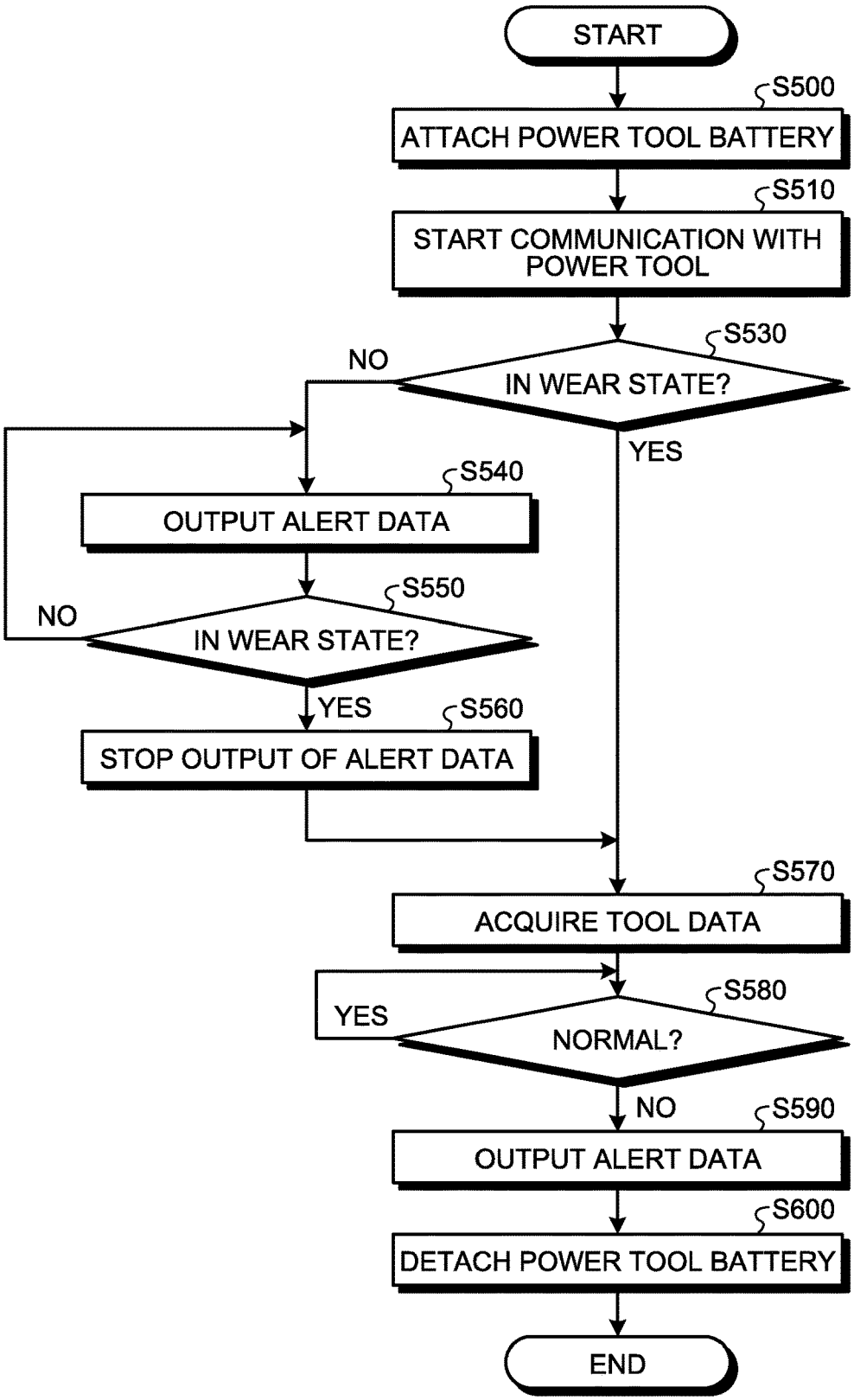
FIG. 16 is a flowchart illustrating an example of the operation of the garment according to a seventh embodiment.

FIG. 16 is a flowchart illustrating an example of the operation of the garment 100 according to the present embodiment. In the present embodiment, when the power tool battery 80A is attached to the adapter 70, communication between the garment communication device 40 and the tool communication device 240 is started.

In the garment 100, when the power tool battery 80A is attached to the adapter 70, the adapter 70 outputs a detection signal indicating that the power tool battery 80A has been attached to the control device 60.

The determination unit 61 determines whether the power tool battery 80A has been attached to the adapter 70, based on a detection signal from the adapter 70. When it is determined that the power tool battery 80A has been attached to the adapter 70 (step S500), the communication control unit 62 starts communication with the tool communication device 240 provided on the power tool 300 (step S510).

The power tool battery 80A is attached to the adapter 70, whereby each of the wear detection device 20, the position detection device 30, the garment communication device 40, the alert device 50, and the control device 60 is started by power supplied from the power tool battery 80A. This process allows the garment communication device 40 to start communication with the external communication equipment 200. The wear detection device 20 detects a biometric signal. The position detection device 30 detects first position data.

The determination unit 61 determines whether the garment body 10 is worn by the worker P1, that is, in the wear state, based on detection data of the wear detection device 20 (step S530).

At step S530, when it is determined that the garment body 10 is not in the wear state (No at step S530), the output unit 65 outputs an alert signal for activating the alert device 50 to the alert device 50. The alert device 50 outputs alert data including at least one of sound, vibration, smell, and light, based on the acquired alert signal (step S540).

After the alert data is output, the determination unit 61 determines whether the garment body 10 is worn by the worker P1, that is, in the wear state, based on detection data of the wear detection device 20 (step S550).

At step S550, when it is determined that the garment body 10 is not in the wear state (No at step S550), the process at step S540 is performed again.

At step S550, when it is determined that the garment body 10 is in the wear state (Yes at step S550), the output unit 65 outputs an alert signal for stopping the activation of the alert device 50. With this process, the activation of the alert device 50 is stopped, and output of alert data from the alert device 50 is stopped (step S560).

The tool data acquisition unit 64 acquires the tool data transmitted from the power tool 300 (step S570).

The output unit 65 determines whether the power tool 300 is being activated normally, based on the tool data acquired by the tool data acquisition unit 64 (step S580).

At step S580, when it is determined that the power tool 300 is being activated normally (Yes at step S580), the process at step S580 is performed again. At step S580, when it is determined that the power tool 300 is not being activated normally (No at step S580), the output unit 65 outputs an alert signal for activating the alert device 50 to the alert device 50. The alert device 50 outputs alert data including at least one of sound, vibration, smell, and light, based on the acquired alert signal (step S590).

When it is determined that the power tool 300 is not being activated normally and alert data is output, the power tool battery 80A is detached from the adapter 70 (step S600). With this process, communication between the garment communication device 40 and the tool communication device 240 is terminated. In addition, the activation of the power tool 300 is stopped.

As explained above, according to the present embodiment, when the power tool battery 80A is attached to the adapter 70, communication between the garment communication device 40 and the tool communication device 240 is started, and when the power tool battery 80A is detached from the adapter 70, communication between the garment communication device 40 and the tool communication device 240 is terminated. The power tool 300 enters the activation-enabled state only when the power tool battery 80A is attached to the adapter 70. The power tool 300 enters the activation-prohibited state when the power tool battery 80A is detached from the adapter 70. With this configuration, in a worksite in which a worker P1 and a third person P2 are present, reduction in workability and occurrence of an unexpected event are prevented and therefore a good work environment can be maintained.

In the present embodiment, alert data is output from the alert device 50 when the worker P1 is not wearing the garment 100. This process prompts the worker P1 to wear the garment 100 based on the alert data.

In the present embodiment, alert data is output from the alert device 50 when the power tool 300 is not being activated normally. This allows the worker P1 to stop using the power tool 300 or perform maintenance of the power tool 300, based on the alert data.

In the foregoing embodiments, for example, when abnormality occurs in the wear detection device 20 or when abnormality occurs in the position detection device 30, the output unit 65 may output an alert signal for activating the alert device 50 to the alert device 50.

In the foregoing embodiments, when the power tool battery 80A is attached to the adapter 70, communication between the garment communication device 40 and the tool communication device 240 is started and the power tool 300 enters the activation-enabled state. When the power tool battery 80A is detached from the adapter 70, communication between the garment communication device 40 and the tool communication device 240 is terminated and the power tool 300 enters the activation-prohibited state. In a case where the garment 100 is provided with a switch that switches between a supply state in which power from the power tool battery 80A is supplied to the electronic equipment provided on the garment body 10 and a non-supply state in which power is not supplied, communication between the garment communication device 40 and the tool communication device 240 may be started and the power tool 300 may enter the activation-enabled state when the switch is operated to set the supply state. When the switch is operated to set the non-supply state, communication between the garment communication device 40 and the tool communication device 240 may be terminated and the power tool 300 may enter the activation-prohibited state.

Other Embodiments

In the foregoing embodiments, the adapter 70 may include the garment communication device 40. More specifically, the garment communication device 40 may be provided in the adapter 70, and the adapter 70 may have the communication function. At least one of the wear detection device 20, the position detection device 30, the alert device 50, and the control device 60 may be provided in the adapter 70.

In the foregoing embodiments, the second position data detected by the position detection device 130 is transmitted as data for distance calculation to the control device 60 of the garment 100 through the external communication device 140 and the garment communication device 40, and the distance data acquisition unit 63 calculates the distance D based on the second position data. In a case where the external communication equipment 200 emits radio waves as data for distance calculation, the distance data acquisition unit 63 may calculate distance data indicating the distance D between the garment 100 and the external communication equipment 200, based on the intensity of the received radio waves. For example, distance data indicating the distance D between the garment 100 and the external communication equipment 200 may be calculated based on the transmission time taken for communication between the garment communication device 40 and the external communication device 140.

In the foregoing embodiments, the garment communication device 40 and the external communication device 140 may wirelessly communicate using a local area network such as Wi-Fi, may wirelessly communicate based on the Bluetooth (registered trademark) standard, or may wirelessly communicate based on the ZigBee (registered trademark) standard, or may perform infrared communication. The external communication equipment 200 can communicate based on these wireless communication methods. The communication between the garment communication device 40 and the external communication device 140 may be started by image authentication.

In the foregoing embodiments, the wear detection device 20 including a biometric sensor detects whether the garment body 10 is worn by the worker P1. For example, the garment 100 may be provided with a switch, and the worker P1 may operate the switch when wearing the garment 100, and communication between the garment communication device 40 and the external communication equipment 200 may be started when the switch is operated. The switch is not necessarily operated by the worker P1. For example, a switch that turns on when the garment body 10 is in the wear state and turns off when the garment body 10 is in the non-wear state may be provided. The garment communication device 40 may start communication when the switch is on, and the garment communication device 40 may terminate communication when the switch is off. The switch may be provided in a button or a fastener of the garment body 10. The switch may turn on when the button or the fastener is done up, and the switch may turn off when the button or the fastener is undone.

In the foregoing embodiments, each of the distance data acquisition unit 63 of the garment 100 and the distance data acquisition unit 163 of the external communication equipment 200 calculates distance data indicating the distance D based on the first position data and the second position data. The distance data acquisition unit 163 of the external communication equipment 200 may acquire the distance data calculated by the distance data acquisition unit 63 of the garment 100 through the garment communication device 40 and the external communication device 140, rather than calculating distance data.

In the foregoing embodiments, the output unit 65 of the garment 100 and the output unit 165 of the external communication equipment 200 individually generate an alert signal based on the distance data and output the generated distance data to the alert device 50 and the alert device 150. The output unit 165 of the external communication equipment 200 may acquire the alert signal output from the output unit 65 of the garment 100 through the garment communication device 40 and the external communication device 140 and activate the alert device 150 of the external communication equipment 200 based on the acquired alert signal, rather than generating an alert signal.

In the foregoing embodiments, the external communication equipment 200 is not necessarily provided with the alert device 150. The external communication device 140 of the external communication equipment 200 transmits the second position data to the garment communication device 40 of the garment 100 and does not necessarily receive the first position data from the garment 100. The garment communication device 40 receives the second position data from the external communication equipment 200 and does not necessarily transmit the first position data to the external communication equipment 200.

In the foregoing embodiments, the garment 100 is not necessarily provided with the alert device 50. The garment communication device 40 of the garment 100 transmits the first position data to the external communication device 140 of the external communication equipment 200 and does not necessarily receive the second position data from the external communication equipment 200. The garment communication device 40 transmits the first position data to the external communication equipment 200 and does not necessarily receive the second position data from the external communication equipment 200.

In the foregoing embodiments, alert data is output when the distance D between the worker P1 and the third person P2 is short. Alert data may be output when the distance D between the worker P1 and the third person P2 is too long. The workability may be reduced also when the worker P1 and the third person P2 are located too far away from each other. For this reason, alert data may be output from the alert device when the distance D is equal to or greater than a predetermined threshold.

In the foregoing embodiments, the power tool 300 may be provided with an alert device. The alert device provided in the power tool 300 may output at least one of sound, vibration, smell, and light as alert data, in the same manner as the alert device 50 and the alert device 150 described above. The alert device provided in the power tool 300 includes at least one of a buzzer outputting sound, a vibration mechanism outputting vibration, an olfactory display outputting smell, and a warning light outputting light. In a case where the power tool 300 has a work area-illuminating device for illuminating a work area, the work area-illuminating device may output light as alert data. In a case where the power tool 300 has an illumination device for energization state indicator (illumination device for main power supply), the illumination device for energization state indicator may output light as alert data. The illumination device for energization state indicator refers to a display device that presents display data indicating that the power tool 300 is in the activation-enabled state. The trigger switch of the power tool 300 is operated, whereby the illumination device for energization state indicator presents display data indicating that the power tool 300 is activated. In other words, at least one of the work area-illuminating device and the illumination device for energization state indicator provided in the power tool 300 may have the function of the alert device.

In the foregoing embodiments, the biometric signal detected by the wear detection device 20 may be transmitted from the garment communication device 40 to a biometric signal management device. The biometric signal management device manages biometric signals during work of the worker P1 carrying out work with the garment 100 on. The biometric signal management device may detect, for example, a sudden change in the biometric signal to detect that the state of the worker P1 suddenly changes. In such a case, the biometric signal management device may generate an alert signal and output the generated alert signal to the alert device. In this way, the state of the worker P1 may be managed based on the biometric signal.

In the foregoing embodiments, the garment 100 may be provided with a sensor capable of detecting a health state of the worker P1. The sensor detects, for example, the heart rate, body temperature, and perspiration of the worker P1 to detect a health state of the worker P1. The control device 60 may determine whether the worker P1 is healthy based on the detection result of the sensor and may activate the alert device 50 or prohibit the activation of the power tool 300 when it is determined that the worker P1 is not healthy.

REFERENCE SIGNS LIST

10 garment body
20 wear detection device
30 position detection device
40 garment communication device
50 alert device
60 control device
60A arithmetic processing unit
60B storage device
60C input/output interface
61 determination unit
62 communication control unit
63 distance data acquisition unit
64 tool data acquisition unit
65 output unit
66 threshold storage unit
70 adapter
71 fixed part
72 battery attachment part
72G guide
73 connection part
74 cable
74A terminal
74B terminal
80 power tool battery
80A power tool battery
80B power tool battery
100 garment
130 position detection device
140 external communication device
150 alert device
160 control device
160A arithmetic processing unit
160B storage device
160C input/output interface
163 distance data acquisition unit
165 output unit
200 external communication equipment
240 tool communication device
260 control device
300 power tool
D distance
P1 worker
P2 third person
R1 first threshold
R2 second threshold
R3 third threshold
S1 alert system
S2 alert system

The invention claimed is:

1. A garment comprising:
a garment body;
a wear detection device configured to detect whether the garment body is worn by a worker;
a control device configured to output an alert signal to control an alert device based on detection data of the wear detection device; and
a garment communication device configured to directly communicate with both external communication equipment carried by a third person and a power tool, without any additional electronic devices between the garment communication device and the external communication equipment, wherein
the control device is further configured to output a tool signal to control the power tool carried by the worker based on whether the garment communication device is in communication with the external communication equipment.

2. The garment according to claim 1, wherein the control device activates the alert device when the control device determines that the garment body is not worn by the worker, based on detection data of the wear detection device.

3. The garment according to claim 1, wherein
the control device outputs an alert signal to control the alert device based on a whether the garment communication device is in communication with the external communication equipment.

4. The garment according to claim 3, wherein the control device activates the alert device when the control device determines that the garment communication device is not in communication with the external communication equipment.

5. The garment according to claim 3, wherein the control device outputs an alert signal to control the alert device based on distance data indicating a distance from the external communication equipment acquired through communication with the external communication equipment.

6. The garment according to claim 5, further comprising a position detection device configured to detect first position data indicating a position of the garment body, wherein
the control device calculates a distance from the external communication equipment based on the first position data and second position data indicating a position of the external communication equipment transmitted from the external communication equipment.

7. The garment according to claim 5, wherein the control device activates the alert device when the distance is equal to or smaller than a first threshold.

8. The garment according to claim 1, wherein the control device prohibits activation of the power tool when the control device determines that the garment communication device is not in communication with the external communication equipment.

9. The garment according to claim 1, wherein the control device outputs a tool signal to control the power tool based on detection data of the wear detection device.

10. The garment according to claim 9, wherein the control device prohibits activation of the power tool when the control device determines that the garment body is not worn by the worker, based on detection data of the wear detection device.

11. The garment according to claim 1, wherein the control device outputs a tool signal to control the power tool based on distance data indicating a distance from the external communication equipment acquired through communication with the external communication equipment.

12. The garment according to claim 11, wherein a first threshold and a second threshold smaller than the first threshold are defined for the distance, and the control device prohibits activation of the power tool when the distance is equal to or smaller than the second threshold, and permits activation of the power tool when the distance is greater than the second threshold.

13. The garment according to claim 12, wherein the control device outputs the alert signal to control the alert device based on the distance and activates the alert device when the distance is equal to or smaller than the first threshold and is greater than the second threshold.

14. The garment according to claim 13, wherein a third threshold greater than the first threshold is defined for the distance, and the control device permits activation of the power tool without activating the alert device when the distance is equal to or smaller than the third threshold and is greater than the first threshold, and the control device activates the alert device and prohibits activation of the power tool when the distance is greater than the third threshold.

15. The garment according to claim 1, wherein the garment communication device communicates with the external communication equipment based on detection data of the wear detection device.

16. The garment according to claim 1, wherein the garment communication device is configured to communicate with the external communication equipment when the power tool held by the worker is activated, wherein the control device outputs an alert signal to control the alert device based on distance data indicating a distance from the external communication equipment acquired through communication with the external communication equipment.

17. The garment according to claim 1, wherein the control device outputs the tool signal after start of communication with the power tool and outputs an alert signal to control the alert device based on tool data indicating a state of the power tool acquired through communication with the power tool.

18. The garment according to claim 1, further comprising an adapter to which a power tool battery is attached.

19. The garment according to claim 18, wherein the garment communication device is configured to communicate with the power tool when the power tool battery is attached to the adapter, and the control device outputs an alert signal to control the alert device based on tool data indicating a state of the power tool acquired through communication with the power tool.

20. An alert system comprising:

external communication equipment configured to communicate with the garment according to claim 1; and an alert device configured to be activated based on an alert signal from the garment.

21. A garment comprising:

a garment body;

a wear detection device configured to detect whether the garment body is worn by a worker;

a garment communication device configured to directly communicate with both external communication equipment carried by a third person and a power tool, without any additional electronic devices between the garment communication device and the external communication equipment; and a control device configured to output a tool signal to control the power tool carried by the worker based on whether the garment communication device is in communication with the external communication equipment.

22. A garment comprising:

a garment body;

a wear detection device configured to detect whether the garment body is worn by a worker;

a garment communication device configured to communicate with external communication equipment carried by a third person and a power tool; and a control device configured to output a tool signal to control the power tool carried by the worker based on distance data indicating a distance from the external communication equipment acquired through communication with the external communication equipment, wherein a first threshold and a second threshold smaller than the first threshold are defined for the distance, and the control device prohibits activation of the power tool when the distance is equal to or smaller than the second threshold, and permits activation of the power tool when the distance is greater than the second threshold.

* * * * *